US006828730B2

(12) United States Patent
Eden et al.

(10) Patent No.: US 6,828,730 B2
(45) Date of Patent: Dec. 7, 2004

(54) MICRODISCHARGE PHOTODETECTORS

(75) Inventors: J. Gary Eden, Mahomet, IL (US); Sung-Jin Park, Yong-In (KR)

(73) Assignee: Board of Trustees of the University of Illinois, Urbana, IL (US)

( * ) Notice: Subject to any disclaimer, the term of this patent is extended or adjusted under 35 U.S.C. 154(b) by 149 days.

(21) Appl. No.: 10/306,632

(22) Filed: Nov. 27, 2002

(65) Prior Publication Data

US 2004/0100194 A1 May 27, 2004

(51) Int. Cl.[7] ..... H01J 40/00
(52) U.S. Cl. ..... 313/538; 313/542
(58) Field of Search ..... 313/538, 542

(56) References Cited

U.S. PATENT DOCUMENTS 3,793,552 A * 2/1974 Glascock et al. ..... 313/539
6,695,664 B2 * 2/2004 Eden et al. ..... 445/24

* cited by examiner

*Primary Examiner*—David Vu
(74) *Attorney, Agent, or Firm*—Brinks Hofer Gilson & Lione

(57) ABSTRACT

A microdischarge photodetector has a photocathode, an insulator and an anode. A cavity of limited size is disposed in the insulator and filled with gas. A voltage applied between the photocathode and the anode produces a plasma. Light incident on the photocathode having photon energies larger than about the work function produces photoelectrons are ejected from the photocathode and accelerated by the plasma electric field. The incident light is detected by detecting an increase in the plasma current or light emission from the plasma. The cavity may be flat or tapered and is designed to optimize detector performance.

75 Claims, 13 Drawing Sheets

MICRODISCHARGE PHOTODETECTORS

RELATED APPLICATIONS

This application is related to currently pending application Ser. Nos. 10/040,300 and 10/062,269, entitled "MICRODISCHARGE DEVICES AND ARRAYS" and "METHOD AND APPARATUS FOR EXCITING A MICRODISCHARGE", respectively, both filed Oct. 26, 2001 in the names of J. Gary Eden, Sung-Jin Park, and Clark J. Wagner and commonly assigned to the assignee of the present application and Ser. No. 10/047,469, entitled "MICRODISCHARGE DEVICES AND ARRAYS HAVING TAPERED MICROCAVITIES" filed Jan. 15, 2002 in the names of J. Gary Eden, Sung-Jin Park, and Jack Chen and commonly assigned to the assignee of the present application, all of which are incorporated herein in their entirety by this reference.

FEDERAL SUPPORT

This invention was made with Government support under Contract F49620-00-1-0372 and Contract F49620-01-1-0546 awarded by the United States Air Force Office of Scientific Research (AFOSR). The Government has certain rights in the invention.

BACKGROUND

The present invention relates to microdischarge devices and, in particular, to microdischarge devices used as light detectors.

It has long been known that electrical discharges are efficient sources of light, and today gas discharge lamps (including fluorescent sources, and metal-halide, sodium, or mercury arc lamps) account for most of the world's light-generating capacity (several billion watts on a continuous basis). Most of these devices are, unfortunately, bulky and frequently have fragile quartz or glass envelopes and require expensive mounting fixtures.

Along the same vein, the photosensitivity of low pressure gas discharges over a broad region of the electromagnetic spectrum has been well known for several decades. Discharge-based microwave and millimeter wave detectors were first demonstrated in the 1950s, and, in 1969, Kaplafka reported the detection of $CO_2$ laser radiation (10.6 $\mu$m) radiation by a He discharge, attributing the effect to photoabsorption by the He diatomic excimer or the dimmer ion. Several groups have also exploited inverse bremsstrahlung to measure relative electron densities in a plasma through the absorption of infrared or far-infrared radiation. More recently, in the 1970s, Farhat, Kopeika and co-workers reported and characterized photodetection in the visible and ultraviolet (UV) with low pressure rare gas lamps. Despite the impressive responsivities measured in the near-UV (5–10 A/W at 300 nm) in their studies, the physical size of conventional gas-filled devices continues to be a severe drawback to their use as photodetectors.

However, with the recent reduction in size of discharge devices, as well as fabrication in other materials, many more possibilities exist for application of these devices. In one example, microdischarge devices may be fabricated in silicon by techniques developed in the integrated-circuit industry. FIG. 1 shows a conventional microdischarge device 100. The microdischarge device 100 is fabricated in silicon and has a cylindrical cavity 102 in the cathode 104 of the device 100. The Si wafer from which the cathode 104 is fabricated is affixed to a copper or diamond heat sink or thermoelectric cooler with conductive epoxy. The anode 106 for the microdischarge device 100 is typically a metal film such as Ni/Cr. A thin dielectric layer 108 deposited onto the silicon electrically insulates the cathode 104 from the anode 106. When the cavity 102 is filled with the desired gas and the appropriate voltage imposed between the cathode 104 and the anode 106, a discharge is ignited in the cavity 102.

Despite this reduction in size, until now microdischarge devices have been used solely as emission devices. The use of such devices and arrays of devices as detectors would thus lead to a host of applications in, for example, remote sensing, biomedical diagnostics, and spectroscopy. Thus, a photodetector that is highly sensitive compared with conventional photodetectors, relatively inexpensive to fabricate into arrays, readily able to be integrated with conventional electronic or optoelectronic devices and amenable to mass production would be of considerable value.

BRIEF SUMMARY

In light of these objectives, as well as other objectives discussed herein, a microdischarge photodetector, method of forming and using the photodector, and detection system using the photodetector are disclosed herein.

In one embodiment the microdischarge photodetector comprises a photocathode, an anode, an insulator disposed between the photocathode and anode, and a gas disposed in a cavity formed in the insulator. The gas has a breakdown voltage and impact ionization coefficient. When the gas breaks down into a plasma, the impact ionization coefficient is sufficient to cause avalanche breakdown when light of photon energy larger than about a work function of the photocathode is incident on the photocathode. The resulting photoelectrons are ejected from the photocathode.

The cavity may be tapered and may extend into the photocathode. The depth of the cavity in the photocathode may be at most about 60 $\mu$m. An optically transmissive material may seal the cavity. A shape of cavity may be independent of material that forms the photocathode.

The photocathode may be a semiconductor. An underlying substrate may be formed from the same material as the photocathode or a different material as the photocathode. The underlying material may be substantially different from the photocathode. The thickness of the photocathode may be between about 1–5 absorption lengths of the peak absorption of the light to be absorbed. The photocathode may be coated with a material having a higher secondary electron emission coefficient or emission in a different wavelength range than the photocathode.

The insulator may comprise a plurality of dielectric layers with at least two of the plurality of dielectric layers having different dielectric constants.

The anode may comprise an electrically conducting screen.

The breakdown voltage of the gas may be at most about 120V so that the plasma may be formed at conventional wallplug voltages.

Arrays of photodetectors may comprise a first set of photodetectors and a second set of photodetectors that are electrically isolated from each other and thus operable independently from each other.

In another embodiment, a method of fabricating the microdischarge photodetector comprises forming the photocathode on the substrate, forming the cavity in the insulator disposed on the photocathode, forming the anode on the insulator, and introducing the gas into the cavity.

The method may further comprise limiting the area of the cavity at the surface of the photocathode to at most about $(500\ \mu m)^2$, extending the cavity into the photocathode, limiting a depth of the cavity in the photocathode to about 60 $\mu$m, sealing the cavity with an optically transmissive material, tapering the cavity in the photocathode, shaping the taper as determined by the lattice structure of the photocathode, or wet etching the photocathode to form the taper.

The method may further comprise forming the photocathode from a semiconductor, limiting the thickness of the photocathode to between about 1–5 absorption lengths for a specific wavelength associated with the incoming optical radiation as above, forming the photocathode on the substrate such that the photocathode contacts the substrate and forming the photocathode and substrate from different materials.

The method may further comprise forming the insulator from a plurality of dielectric layers, at least two of which have different dielectric constants, affixing a conducting screen to an end of the cavity, forming the anode from an electrically conducting screen, or limiting the breakdown voltage of the gas or operating voltage of the photodetector to at most about 120 V.

The method may further comprise arranging a plurality of photodetectors into an array of photodetectors and filling different cavities in the array with different gases or fabricating the photocathodes such that a first set of photocathodes and a second set of photocathodes are formed from different materials that have different work functions.

In another embodiment, a method of detecting light using a microdischarge photodetector comprises applying a voltage between a photocathode and anode that is sufficiently large to form a plasma of a gas in a cavity disposed in an insulator separating the photocathode and anode and creating avalanche breakdown of the plasma, illuminating the photocathode with incident light of photon energy larger than about a work function of the photocathode to eject photoelectrons into the plasma, and detecting an avalanche of the photoelectrons.

The method may further comprise detecting the arrival of photons (the incident light) at the detector by observing the avalanche breakdown by detecting an increase in light emission from the photodetector or detecting the incident light by detecting an increase in current flowing in the photodetector. The method may comprise forming a plasma from gas in a cavity disposed in the photocathode that extends from the cavity in the insulator, illuminating a semiconductor photocathode with the incoming light from the optical source to be detected, illuminating the photocathode with the source light through an optically transmissive material that seals the cavity, illuminating tapered sidewalls of the cavity in the photocathode, or forming the plasma by applying a voltage between the photocathode and the anode.

In an array of photodetectors, the method may further comprise forming plasmas of different gases in different cavities for different photodetectors in the array, illuminating the photodetectors in the array of photodetectors such that a first set of photocathodes in the array are illuminated with light of photon energy larger than about a work function of the first set of photocathodes and illuminating a second set of photocathodes in the array with light of photon energy smaller than about the work function of the second set of photocathodes, thereby ejecting photoelectrons into plasmas associated with the first set of photocathodes but not the second set of photocathodes.

Another embodiment is a detector system that comprises an emission source and a microdischarge photodetector. The photodetector comprises a photocathode, an anode, an insulator disposed between the photocathode and anode, and a gas disposed in a cavity formed in the insulator. The photodetector is disposed in the system to detect light from the emission source that is incident on the photodetector and generate a signal that is proportional to an amount of the incident light falling on the photodetector.

The detector system may further comprise a communication device that receives the signal from the photodetector and notifies an individual of the signal. This communication device may be a display that displays results to an observer.

In the detector system, the cavity may extend into the photocathode, which may be a semiconductor. The cavity may be tapered. Additionally, the insulator may comprise a plurality of dielectric layers, at least two of which may have different dielectric constants. An optically transmissive material may seal the cavity. A thickness of the photocathode may be between about one and five absorption lengths of the incident light.

The detector system may further comprise a substrate that is a substantially different material from the photocathode. A surface of the photocathode may be coated with a material having a higher secondary electron emission coefficient than the photocathode. The anode may comprise an electrically conducting screen. An operating voltage of the photodetector may be at most about 120 V.

The detector system may be configured to supply the signal when a voltage is applied between the photocathode and anode that is sufficiently large to form a plasma of the gas and the photocathode is illuminated with the incident light, which has a photon energy larger than about a work function of the photocathode to thereby eject photoelectrons into the plasma, and the detector is configured to detect an avalanche of the photoelectrons. This signal may be proportional to an increase in current flowing in the photodetector or light emission from the photodetector.

The detector system may further comprise an array of the photodetectors. At least one cavity in the array may contain a different gas from another cavity in the array, at least one photocathode in the array may have a different work function from another photocathode in the array, at least one photocathode in the array may be coated with a material having a higher secondary electron emission coefficient than the at least one photocathode, or he array may be configured such that at least one photodetector in the array is operable independently from another photodetector in the array.

BRIEF DESCRIPTION OF THE DRAWINGS

FIG. 8*a* shows the spectral response of an embodiment of the microdischarge detector of the present invention as well as that of a conventional Si avalanche photodiode on a logarithmic scale, while FIG. 8*b* shows the spectral response of the microdischarge detector on a linear scale;

DETAILED DESCRIPTION

Figure 1:
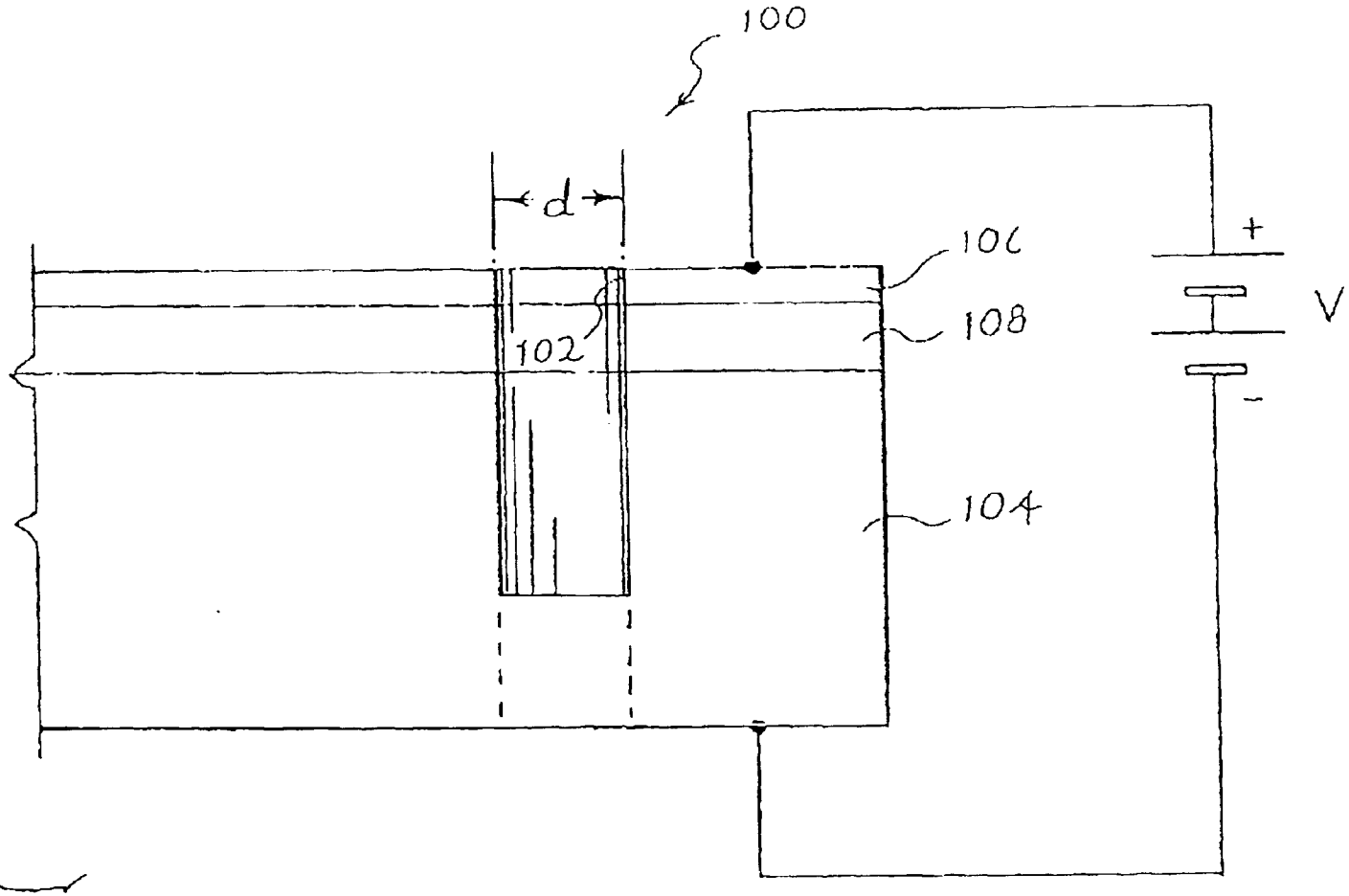
Fig. 1 (PRIOR ART)
FIG. 1 is a cross-sectional view of a conventional microdischarge device.

The present invention provides microdischarge photodetectors and arrays of microdischarge photodetectors that are relatively inexpensive and easy to fabricate using conventional techniques, are readily able to be integrated with conventional electronic or optoelectronic devices, and amenable to mass production. The microdischarge photodetectors have several optical characteristics that are superior to those of conventional miniature photodetectors.

Specifically, microdischarge photodetectors have several advantages over conventional miniature photodetectors, such as silicon avalanche photodetectors (APDs). One factor contributing to this result is that the avalanche region in the microdischarge photodetector can be more than 10 times larger than that of the typical APD while the actual active (emitting) material in the microdischarge photodetector can be many times thinner than the active material in the conventional APD. This remains true even as the present microdischarge photodetectors may be formed to have spatial resolutions comparable to pixels in a CCD display (typically under about 50 $\mu$m) without extensive reduction in the responsivity of the spectral region of interest. The small physical dimensions of microdischarge devices allows them to operate at pressures much higher than those accessible to conventional, macroscopic discharge devices.

A second advantage of the microdischarge photodetector is that if a cavity is present in the photocathode, the cavity can be micromachined or etched in a material such as Si. This is advantageous for manufacturing and electronics purposes as the manufacture of the microdischarge photodetectors is fully compatible with conventional semiconductor fabrication techniques. However, if a photoresponse different from that afforded by Si is desired, at least the portion of the photocathode on which light will be incident can be coated with a thin film of another material that provides the desired spectral response or sensitivity. This enables the microdischarge photodetector to be selected from a wider range of materials than the conventional APD and permits a single inexpensive platform, that of Si, to be used over a much broader spectral region than was possible previously.

Furthermore, although the microdischarge photodetectors can be fabricated in any shape, microdischarge photodetectors that exhibit an increase in surface area, most notably those with tapered cavities, permit a shallow hollow cathode relative to a conventional planar structure to be fabricated, thereby enabling easy modification of the electrical properties of devices and optimization of the responsivity, as desired. Photodetection is available at voltages below the standard wallplug voltage of 120V, which permits an array of microdischarge photodetectors to be used with conventional inexpensive electronic circuits. This is to say that the breakdown voltage of the gas in the cavity may be about 120V so that the operating voltage of the device is about 120V. However, for some devices, higher voltages may be required. Preferably, the maximum operating voltage is no more than about 300V. The voltages applied to the detector may be DC, AC (e.g. RF, microwave) or pulsed. The latter two serve to improve the sensitivity of the device when combined with synchronous detection.

Experiments were conducted over the past two years to characterize the detection of UV, visible, and near-infrared radiation by Si microdischarge devices. Responsivities as high as 950±250 A/W were measured at 625 nm for a device having a 50 $\mu$m square, inverted pyramidal Si electrode and operating in Ne at pressures up to 800 Torr. The experiments reveal that the semiconductor serves as a photocathode and the plasma as the electron multiplier via avalanche. Therefore, this device differs fundamentally from conventional gas photodetectors; rather, it behaves as a mesoscale photomultiplier in which the conventional dynode chain is replaced by a plasma functioning at atmospheric pressures. Since the operation of 30×30 arrays of microdischarge devices (50 $\mu$m square with 50 $\mu$m pitch) has already been reported, the realization of low cost, and yet sensitive and robust, photodetector arrays is feasible.

Figure 2A:
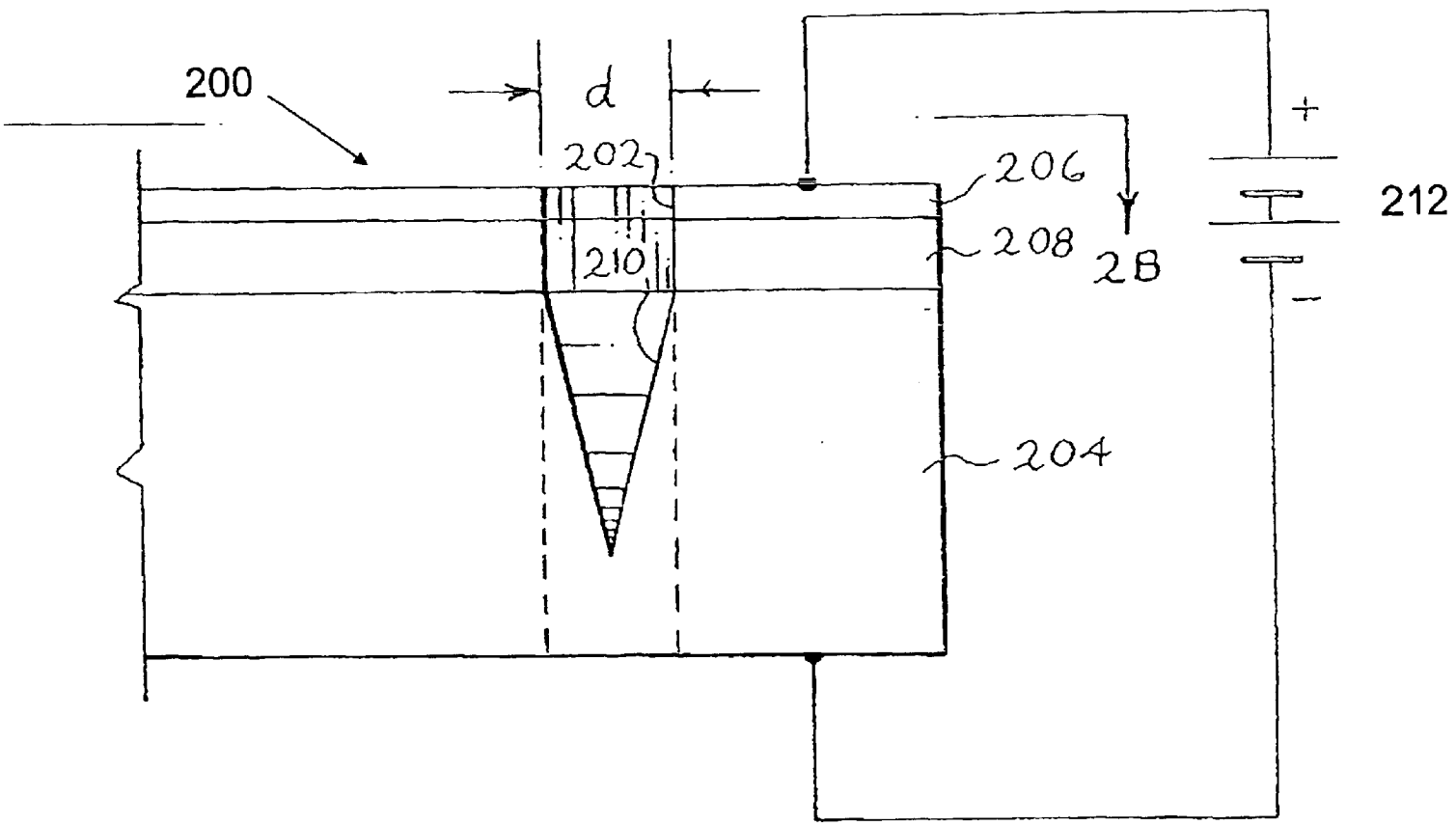
FIGS. 2*a* and 2*b* are cross-sectional and top views, respectively, of a first embodiment of the microdischarge detector of the present invention.
Figure 2B:
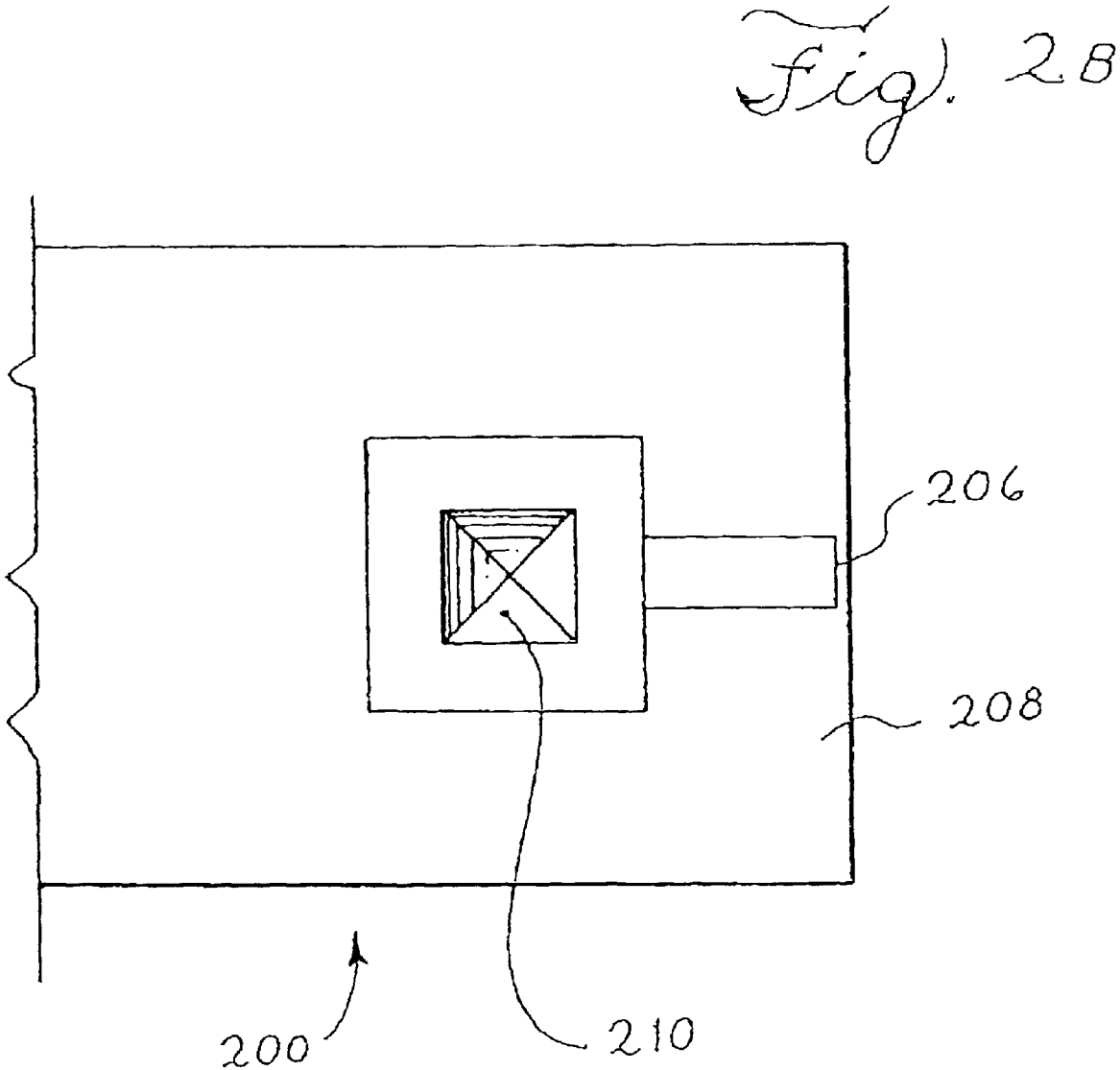
Figure 3:
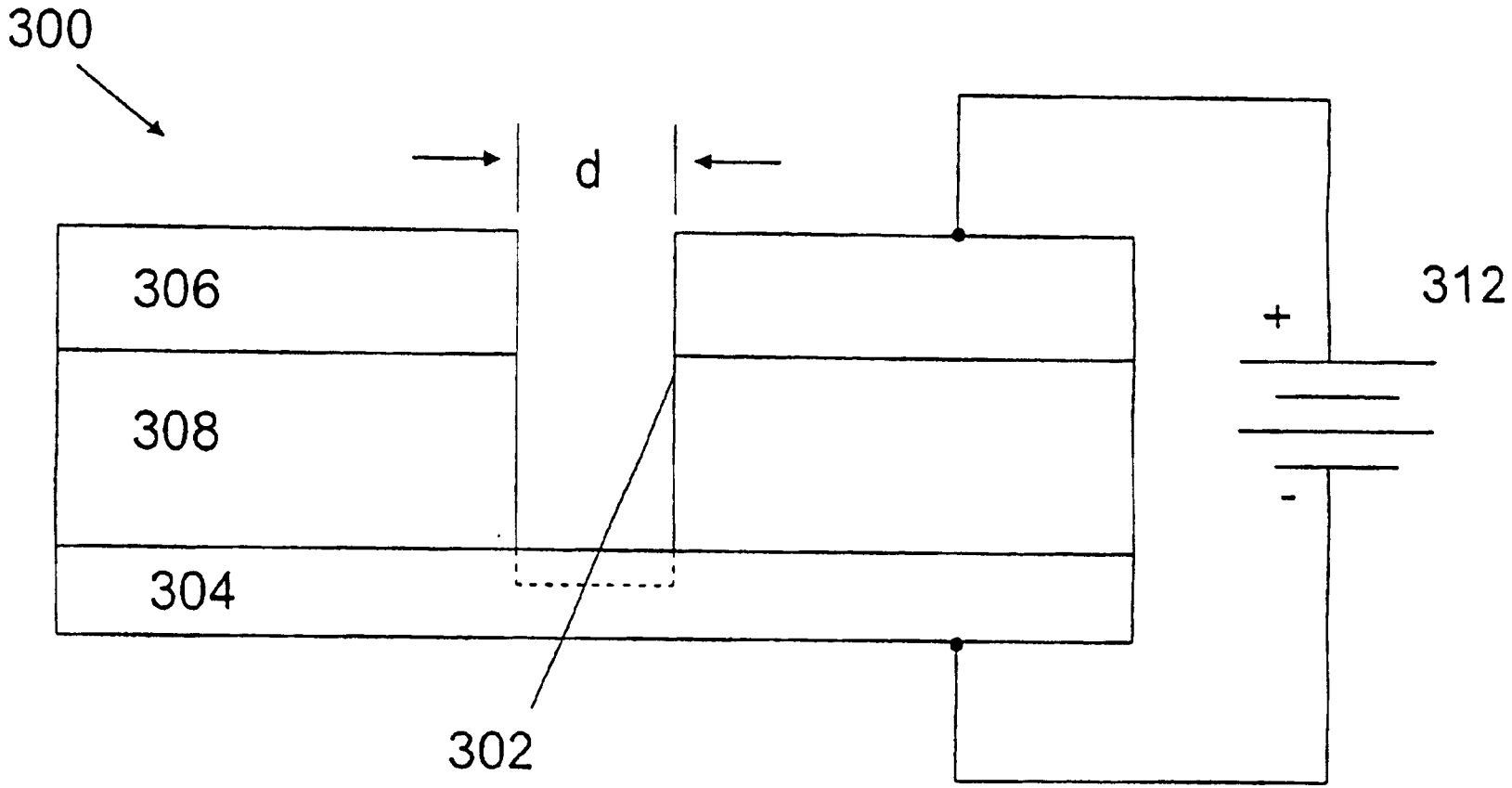
FIG. 3 is a cross-sectional view of a second embodiment of the microdischarge detector of the present invention.

The fabrication of microdischarge devices has been described in detail previously in the related references but has been modified to make them more suitable for detection rather than emission. Embodiments of a microdischarge detector (not drawn to scale) are shown in FIG. 2 (split into the cross-sectional view of FIG. 2*a* and the top view of FIG. 2*b*) and 3. The microdischarge detector 200, 300 has a photocathode (here a semiconductor layer) 210, 304 an insulator 208, 308 on the photocathode 210, 304 and an anode (conductive layer) 206, 306 on the insulator 208, 308. A cavity 210 is formed in the semiconductor wafer or film that forms the photocathode 204, the dielectric 208, and the anode 206 in the first embodiment of FIG. 2. Although formation in the latter two layers is not required, the sensitivity may be increased by forming the cavity in the semiconductor as discussed later. FIG. 3 illustrates an embodiment in which the cavity 302 extends through the insulator 308 and the anode 306, but not into the photocathode 304. The total thickness of the insulator 208, 308, the anode 206, 306, and the material 210, 304 from which the photocathode or photocathode cavity 210 is made is quite thin, preferably at most 1 mm and more preferably several tens to hundreds of microns.

As shown in FIG. 2, the cavity 210 may have a tapered shape formed in a direction transverse to the layers in which it is present. Embodiments of tapered cavities, including preferable angular ranges (which are between about 20 and 45 degrees) may be found in currently pending application Ser. No. 10/047,469. Although the shape of the cavity 210 (308 in FIG. 3) can be fabricated in any shape, for Si, the semiconductor used in the experiments, an inverted square pyramidal is relatively useful due to the properties of the lattice structure as well as the processing technique used. Of course, other shapes are also possible, depending on the semiconductor material and/or processing technique used. The slope of the cavity alters the electric field present in the cavity.

In addition, the size of the cavity is selected for the application. In general, as the various applications for which the detectors will be used tend to need relatively high spatial resolution, the area of the photodetectors may be quite small, for example, on the order of $(10\ \mu m–500\ \mu m)^2$, with the base of the pyramid being 10–100 $\mu$m square. The cavity may extend through the dielectric 208, 308 and into the material 204, 304 forming the photocathode cavity such as the square pyramidal photocathode 210 or may terminate therewithin, as seen in FIG. 3. Although the cavity 210 does not have to be tapered, numerous reasons exist for tapering the cavity, among which are: the increased surface area of the photocathode available to be illuminated by the impinging light and concomitant increase in the subsequent number of photoelectrons, broader range in current over which the device will operate stably, and modification of the electric field in the cavity to improve the device sensitivity. The usefulness of increasing the cavity depth (so that more surface area and thus electrons are created) may be limited to about 50–60 $\mu$m as beyond this depth the electric field characteristics in the lower portion of the taper may not enable an increase in the sensitivity. In other words, beyond this depth, the contribution of electrons from the lower portion of cavity decreases substantially.

If the cavity is formed in the photocathode, conventional processing techniques, such as conventional semiconductor photolithographic processing techniques, may be used. Anisotropic wet chemical etching is one example of a well-established technique that is simple and inexpensive to use. The pyramidal shape of the cavity is caused by the difference in the etch rates of the etchant along the different crystalline planes of Si. This is to say that the shape of the cavity may be dependant on the semiconductor material used due to the disparity in the etch rates along the different crystalline planes in different material systems. Wet chemical etching and other conventional semiconductor fabrication processes are well known in the semiconductor and MEMS fields. Other techniques such as mechanical and laser drilling may alternately be used to form a tapered cavity. However, these techniques may be relatively more costly and time consuming than conventional semiconductor photolithographic processing techniques.

Other geometries for the photocathode cavity may also be desired. For example, the photocathode may simply have a cylindrical cross-section and a flat bottom. Additionally, the formation of ridges (concentric rings) on the bottom of an otherwise flat or tapered cavity will alter the electric field and may increase the number of electrons emitted. The resulting enhancement in responsivity may offset any increase in the cost of fabrication.

The cavity is filled with a gas selected for its breakdown voltage and/or impact ionization coefficient present in the plasma formed by the gas at breakdown. Although light is generally produced when the voltage difference between the photocathode and anode creates an electric field in the portion of the cavity in the insulator sufficiently large to electrically break down the gas (typically about $10^4$ V/cm), selection of the appropriate gas and gas characteristics is dependent on detection of light impinging on the cavity. This light generally escapes from the cavity through at least one end of the cavity, although the device may also be sealed so as to minimize the radiation escaping from the cavity. Either DC or AC (RF, microwave, etc.) voltages may be applied to produce the discharge. The gas may be any single gas, gas mixtures, or vapors having the desired properties. Examples of gases are the rare gases (He, Ne, Ar, Xe, and Kr), and $N_2$ or gas mixtures such as Ar/Hg vapor, gas mixtures containing at least one halogen-bearing molecule such as $CCl_4$, $F_2$, $NF_3$, $XeF_2$, $N_2F_4$, HCl, $Cl_2$, $I^2$, HI, and mixtures of Xe and $O_2$, $N_2O$ or $NO_2$ gases. As used herein, the term gas describes all of the above, single gas, gas mixtures, or vapors.

In addition, the detector may also be operated such that a plasma formed by the gas is not present until light is incident on the photodetector. This decreases the power consumed by the detector as neither current nor emission would be generated until the detector actually detects the incident light.

The photocathode 204, 304 preferably has a relatively large conductivity, with a resistivity not greater than about 50 Ω-cm. The electric field is established in the cavity 202, 308, across the insulator 208, 308 by a voltage source 212, 312 connected between the photocathode 204, 304 and the anode 202, 306. The photocathode 204, 304 and the anode 206, 306 serve as electrodes for the device 200, 300. Ohmic contacts to the photocathode 204, 304 (or underlying contact layer) and the anode 206, 306 that permit an external voltage to be applied to the layers are not shown. The potential difference across the dielectric 208, 308 may create a discharge in the gas present in the cavity 202, 308.

One of the distinct advantages of the photocathode over semiconductor photodetectors is that the material quality of the photocathode may not be extremely important. One reason behind this is that the photocathode in the detector is used to eject electrons rather than serving to transport electrons. Thus, unlike many conventional devices, control of the surface states and the mobility of carriers in the photocathode may not be of paramount importance.

The photocathode 204, 304 may be fabricated on a base material, such as an insulating or conducting substrate, one example of which is a semiconductor substrate. The photocathode may be grown on the substrate by deposition such as chemical vapor deposition (CVD) including metalorganic chemical vapor deposition (MOCVD), molecular beam epitaxy (MBE), liquid phase epitaxy (LPE), vapor phase epitaxy (VPE) or any other technique known in the art. A semiconductor layer may be present between the substrate and the photocathode. This semiconductor layer may be fabricated by other techniques known in the art, such as diffusion into an insulating substrate or affixture to the semiconductor substrate. The doping of the substrate is determined according to the device design. For example, the backside semiconductor substrate may doped in excess of about $10^{18}$ $cm^{-3}$ to allow easier and better contact between the semiconductor layer and the voltage source. The doping of the semiconductor photocathode is chosen such that the conductivity of the photocathode allows the discharge electric field to extend a distance of between about 1–5 absorption lengths below the photocathode surface for the wavelength of interest.

The semiconductor substrate is typically silicon since silicon is inexpensive and fabrication techniques are well known. However, other elemental and compound semiconductors may be used, including column IV semiconductors such as Ge and diamond, and SiGe, SiC, III–V semiconductors such as GaAs, InP, GaN, and ternary and quaternary compounds, and II–VI semiconductors such as ZnSe. Similarly, semiconducting polymers may be used. The use of these materials may be advantageous for various systems. Similarly, the types of materials and methods to make ohmic contact to the photocathode are well-known in the art of semiconductor device fabrication and will not be discussed.

Additionally, the dielectric layer and/or anode may be an optically transmissive material that does not substantially absorb light of the wavelength to be detected. Optically transmissive material transmits a substantial proportion of the light impinging substantially normal to the surface of the material. Preferably, the transmission is at least about 70–80% of the incident light, and may be above 90% if an antireflection coating is added to the material on which the light to be detected impinges. While it is not necessary that the optically transmissive material be optimized for a range of emission wavelengths of light emitted from the photodetector, it may be merely enough for the incident light to be detected by the photodetector.

Preferably, the photocathode is relatively thin as it absorbs light impinging on it and emits photoelectrodes. Thus, the thickness of the photocathode may be preferably about 1–5 absorption lengths of the light to be absorbed. This translates in typical semiconductors such as Si to about 1–5 $\mu$m for above bandgap radiation. Of course, the photocathode may be much thinner, down to about 100 Å, so long as the desired responsivity is achieved. Consequently, this invention permits the shape of the photocathode cavity to be decoupled from the cathode emission characteristics. Specifically, one material, such as Si, may serve as the base 204, 304 for the photocathode, which itself consists of a material that is substantially different from the photocathode material. One definition of the term substantially different materials is materials that have different emission properties, differing substantially in number of photoelectrons ejected into the cavity for a particular photon energy and incident intensity or differing in spectral range of responsivity (such as emitting electrons for incident photons above 1.1 eV or 1.4 eV). Other materials that are substantially different may have different mechanical properties, such as different lattice constants.

The base provides mechanical support and electrical contact to the photocathode, but it may also be chosen for other reasons. These alternative reasons may include either economic reasons or fabrication reasons, i.e. fabricating a particular shape for the photocathode cavity may be realized more easily in one photocathode material than if the same desired cavity shape were to be fabricated in a wafer of a different base material. Therefore, although not illustrated in FIG. 2*a*, the photocathode 210 may be a thin film, nominally about 1–5 absorption lengths at the desired wavelength, deposited onto the base 204. Thus, this invention permits a wide range of materials to be employed economically as the photocathode. Furthermore, the photocathode, or a portion thereof, may be coated with a material such as MgO, which has a high secondary electron emission coefficient and will serve to increase the sensitivity of the device or a material having emission in a different wavelength range than the underlying photocathode.

A tradeoff exists between photocathodes having relatively small and large thicknesses if the photocathode is a crystalline material. Using small thicknesses enables the photocathode to be disposed on different substrates without causing problems such as lattice strain, which may adversely affect the material characteristics of the photocathode in a number of ways. However, the absorption of the photocathode is limited by the absorption coefficient at the photon energy of the incident light in conjunction with the thickness of the photocadthode. On the other hand, as the thickness of the photocathode increases, the amount of light impinging on the photocathode that is absorbed by the photocathode increases. However, while more light is being absorbed and photoelectrons generated by the absorbed light increase, the photoelectrons generated more than a mean free path away from the emission surface may be reabsorbed by the photocathode and thus not contribute to the photoelectrons emitted from the photocathode. One way to increase the photoelectrons generated may be similar to the manner in which solar cells operate, i.e. forming the photocathode from a reverse-biased p-n junction in which the carriers are generated in a relatively thick depletion region. As above, however, this increases the thickness of the semiconductor layer, limiting the substrate material on which the photocathode is disposed as well as complicating the fabrication if a tapered (or otherwise structured) cavity exists within the photocathode.

Of course, this is not to say that the photocathode need be crystalline. One of the distinct advantages of the photodetector over similar emission devices is that neither the nature of the emission material (if either crystalline or non-crystalline), nor the quality of the crystalline emission material may not be important so long as adequate photoresponse is obtained. That is, so long as a sufficient number of photoelectrons are ejected from the photocathode material into the plasma when the light is incident on the photocathode to give sensitivity in the wavelength range of interest, it may not be crucial for the actual photocathode to have excellent material characteristics in other respects such as having a high electron mobility.

Turning away now from the photocathode, a dielectric material with a relatively high resistivity, preferably about at least several Ω-cm may be used to form the insulator, which electrically isolates the anode from the photocathode. Preferably, the dielectric layer has excellent thermostability and high dielectric strength, e.g. $T_g$>200° C. and at least $10^4$ V/cm, respectively. The dielectric layer may be formed by growing, evaporating, spin coating, attaching with conductive paste or otherwise depositing a film onto the photocathode. The insulator may be formed from oxide and nitride films such as $SiO_2$ or $Si_3N_4$ or a polymer such as polyimide, which has exceptional thermostability and dielectric strength. For example, the breakdown voltage for a polyimide film about 5 $\mu$m thick is approximately 1.2 kV, giving a dielectric strength in excess of $10^6$ V/cm. Other dielectrics, resins and polymers, for example KAPTON, may be used as long as the material retains its insulation properties at the material thickness required for adequate dielectric strength.

The insulator may be formed from a layer of a single material or multiple films of different materials (having at least one different dielectric constant) in order to improve both individual device and array performance. Measurements have shown that a multiple layer dielectric (containing, for example, about 0.5 $\mu$m $Si_3N_4$, 0.5 $\mu$m $SiO_2$, and several microns of polyimide) not only improves the voltage-current characteristics of individual microdischarge devices, but also makes it possible to realize stable operation of large arrays (for example, 30×30) of devices. If, on the other hand, the dielectric layer is a single film of polyimide, for example, it is difficult to operate discharge arrays larger than approximately 5×5. This may not be the case with microdischarge photodetectors.

The thickness of the insulator may not be important with regard to absorption of the light; however, with increasing thickness, the electric field in the cavity decreases (as the strength of the field is inversely proportional to the thickness of the insulator). Thus, a larger voltage is needed to reach the electric field required to form the plasma. Thus, there is a practical limit to the thickness of the insulating layer of at most about 500 $\mu$m. Preferably this thickness is on the order of about a micron to several tens of microns.

The anode 206, 306 is generally planar and is fabricated from one or more thin layers of which at least the layer closest to the plasma has good electrical conductivity. As long as the anode conducts current without substantial loss, the thickness of the anode is unimportant, unless the anode resistance is important to the frequency response of the device. Common metals that may be used as the anode include copper, aluminum, gold, silver, tungsten, molybdenum, nickel, and zinc and alloys thereof. Other conductors include polymers containing carbon black and other conducting polymer materials or highly doped crystalline, polycrystalline or amorphous semiconductor films such as Si. In addition, rather than the anode being formed from an optically opaque material in the wavelength range of the light to be detected, it may also be fabricated from a solid layer of an optically-transmissive material (at the wavelength of the light to be detected) such as ITO. If the anode is formed from an optically opaque material, as shown in FIGS. 2*a* and 2*b*, the cavity extends through the anode to permit light to impinge on the photocathode. The anode is preferably sputtered, plated, or otherwise disposed onto the insulator to establish a film of conducting material around the rim of the cavity in the insulator.

Figure 4A:
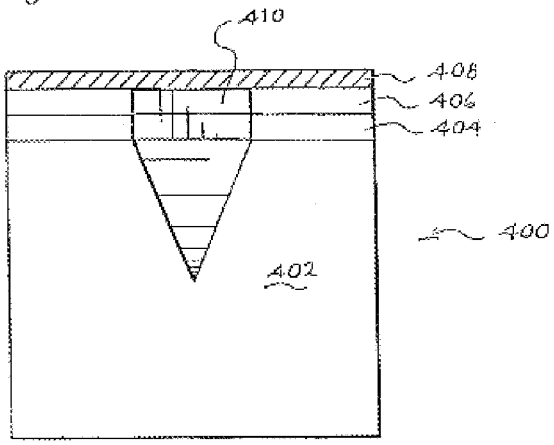
FIGS. 4*a* and 4*b* are cross-sectional and top views, respectively, of a third embodiment of the microdischarge detector of the present invention.

In another embodiment, shown in the cross-sectional view of FIG. 4*a*, the microdischarge detector 400 includes an insulator 404 and a conducting screen electrode 408 that is in contact with and extends across the anode 406. Furthermore, anode 406 may be eliminated entirely. Addition of the screen 408 improves both the lifetime and light output of the microdischarge detector 400, making it more efficient as discussed in the related applications as well as increasing the efficiency of collection of the photoinduced electrons by altering the shape of the electric field in the cavity 410.

Figure 4B:
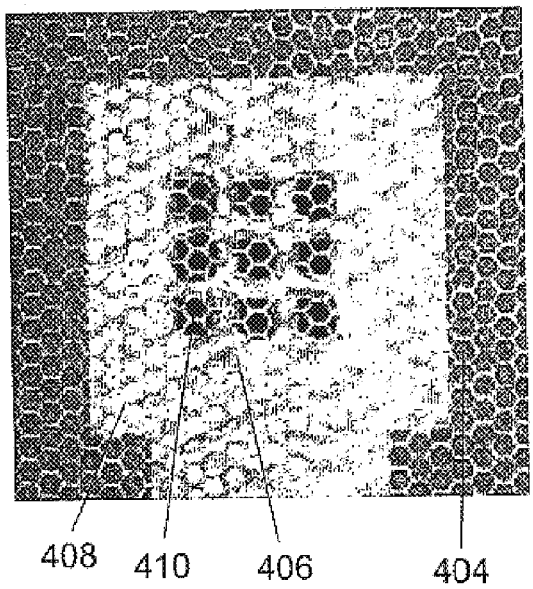

The screen 408, as shown in the top view of FIG. 4*b*, preferably has openings that are comparable to or smaller than the area of the cavity 410. The photocathode 402, the insulator 404 and the anode 406 may all be formed from the same materials and in the same manner as the analogous layers above. Although FIG. 4*a* depicts the screen 408 as mounted on the anode 406, the screen may replace the anode 406. The screen 408 presents a more uniform electrostatic potential to the discharge in the cavity 410. Furthermore, although not illustrated in FIG. 4*b*, the screen opening size and shape can be chosen in concert with the cavity 410 such that, for every device, the screen opening has the same position and orientation with respect to the cavity 410. The screen openings may have the same geometries of as the cavity 410 (e.g. rectangular, circular) to improve the symmetry of the device.

Preferably, the screen is constructed of a metal such as Ni, Au, or Cu, which are available commercially as sample holders for Transmission Electron Microscopy (TEM) and is chosen such that most of the light to be detected by the photodetector and that reaches the screen passes through the screen to impinge on the photocathode. The thickness of the screen may be similar to that of the anode and the openings and shape may be dependent on the diameter and shape of the cavity. Conductive materials, such as indium tin oxide (ITO), deposited onto a transmissive window (such as quartz) neither of which substantially absorbs visible light, may be used to form the screen rather than the above metals.

Figure 5:
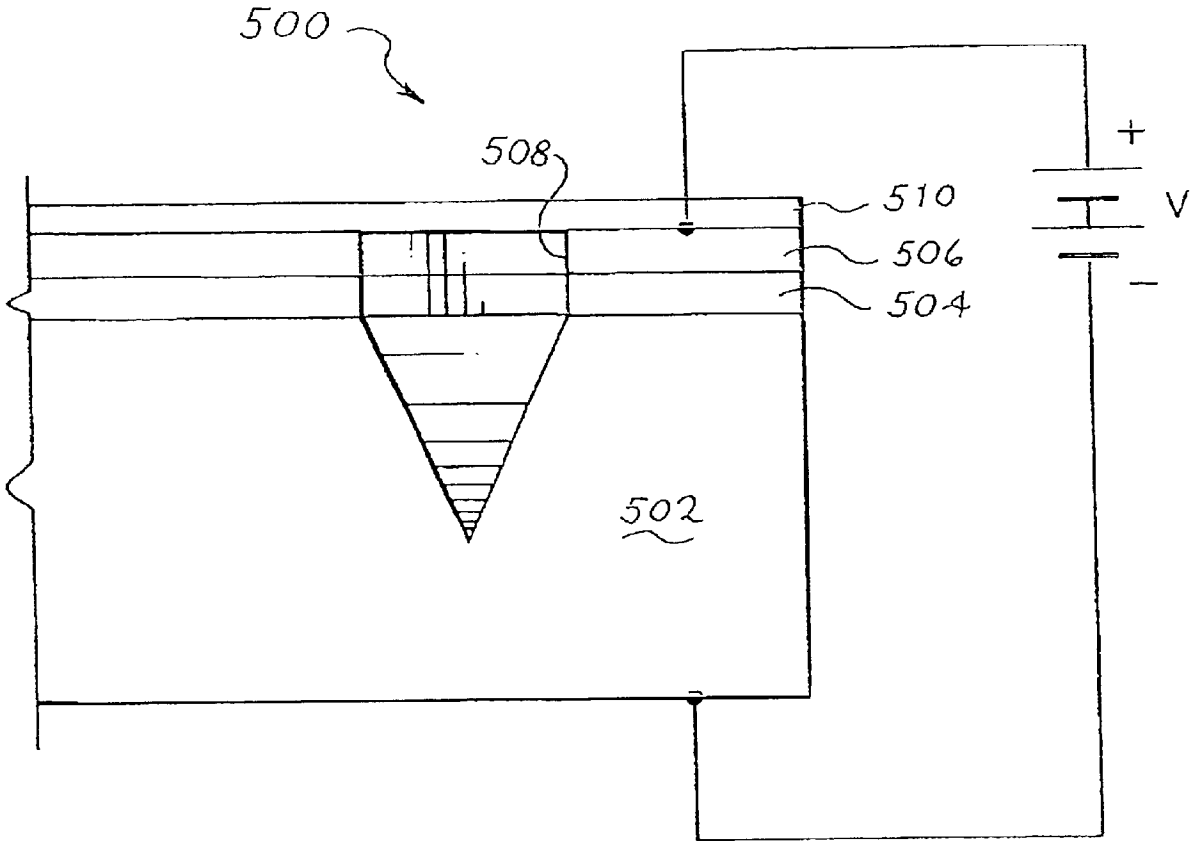
FIG. 5 is a cross-sectional view of an embodiment of the microdischarge detector of the present invention.

In another embodiment, shown in FIG. 5, the microdischarge detector 500 is similar to that of FIG. 2. In this embodiment, in addition to the photocathode 502, insulator 504, and anode 506, a sealing material 510 covers the cavity 508. The sealing material 510 is formed from an optically transmissive material and is preferably flexible. The optically transmissive material transmits light at the wavelengths to be detected.

A conventional plastic laminate, glass, quartz or mica may be used to seal the device 500. One problem with the plastic laminate is that the plastic outgasses impurities into the gas in the cavity 508 and may limit the lifetimes of laminated microdischarge detector 500. However, this is not a fundamental limitation on the device lifetime, and lifetime may be increased when using sealing materials that outgas less. Similarly, depositing or otherwise affixing a thin transmissive film such as tantalum oxide or glass onto conventional laminating sheets will impede or eliminate the outgassing process and may thus extend the lifetime of the microdischarge detector. Another alternative may be a vacuum baking procedure to significantly reduce the outgassing of conventional laminate sheets. As above, a screen may be added to the basic structure before sealing.

The cavity may be sealed while containing the desired gas at the proper pressure (for example, 500 Torr of Ne) by laminating a plastic sheet on to the microdischarge detector or array, thereby sealing the microdischarge detector while still allowing the light to be detected to pass through the sealing material. Another method is to "hard seal" the devices to a window having a conducting film or a fine metal grid on one side. The window may be formed, for example, from glass, sapphire, or quartz. The bonding process takes place with the conductor facing the anode and bonding occurs along the entire perimeter thereof. When completed, this structure is robust and compact, requiring only electrical connections to an appropriate power supply or supplies. One method for sealing the microdischarge photodetector with a window in an inexpensive package is with glass frit. This can presently be performed at temperatures approaching 300° C.

One method of fabrication of the sealed microdischarge detector having additional electrode and dielectric layers is to mechanically assemble the various layers on the substrate by individually positioning or forming the photocathode, insulator, and anode on the substrate and subsequently forming the cavity by etching, drilling, or laser micromachining. Alternatively, the cavity may be pre-formed in the various layers and then aligned during assembly. After the layers have been assembled and the cavity formed, the cavity may then be filled with a specified amount or pressure of a selected gas or vapor optimized for detection and then sealed while containing the desired gas or vapor at the proper pressure.

Figure 6:
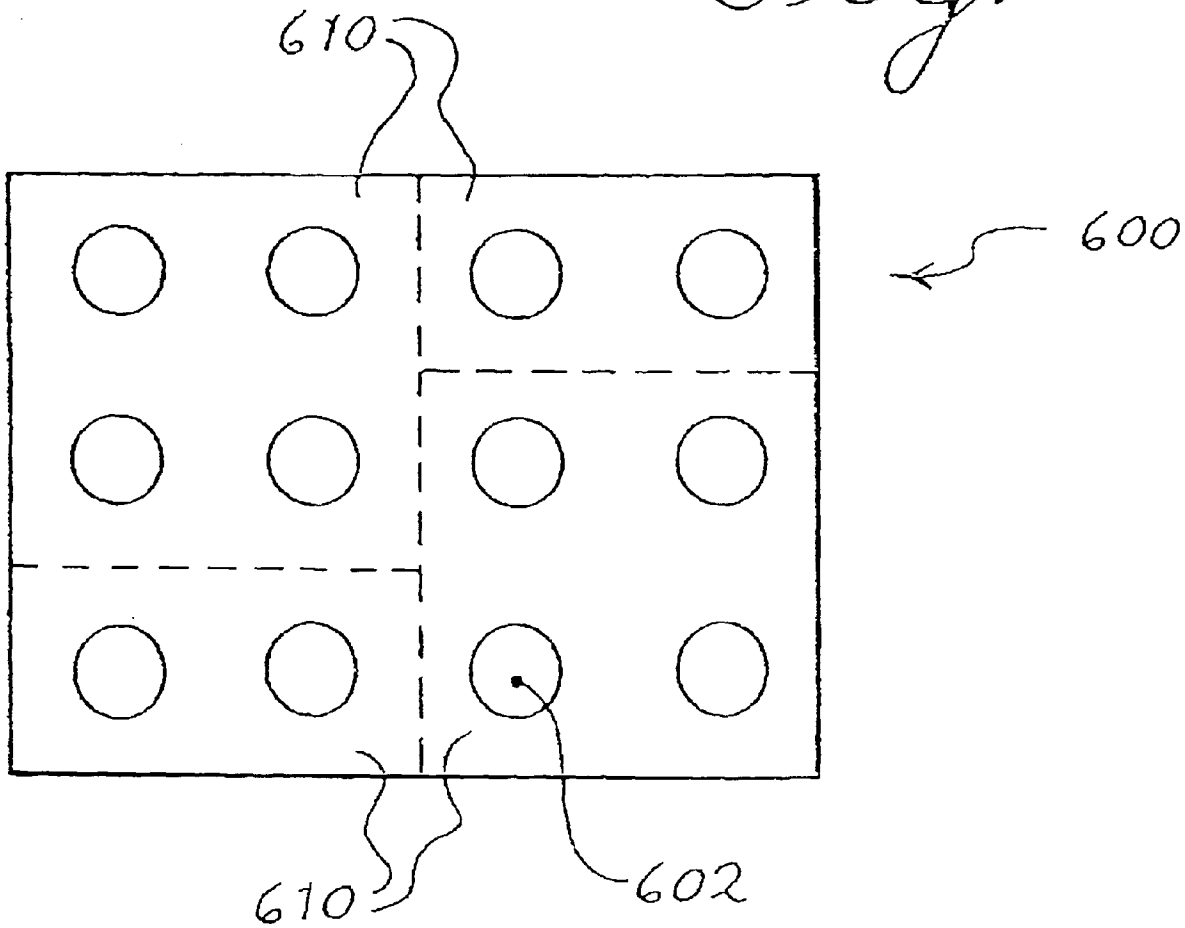
FIG. 6 is a top view of an array of microdischarge detectors of the present invention.

The above embodiments have focused on a single microdischarge detector; however, as shown in FIG. 6, a plurality of microdischarge detectors may be assembled into a planar array of devices 600. The individual devices 602 in the array 600 may be formed from any of the above embodiments. The array can consist of any number of individual devices, from a few tens of devices to millions of devices, as determined by the requirements of the particular application in which the array is to be used. In any array, the photocathodes, gases, cavities, and operating conditions (e.g. effective electric field in the cavity, gas pressure) in each individual detector may be the same or different. Thus, each detector may detect light of one wavelength or light of different wavelengths and the array may or may not detect light substantially uniformly with respect to each other depending on the desired application. Further discussion will be provided below.

Ohmic losses become a problem if one wishes to fabricate large arrays of microdischarge detectors. Voltages are not supplied to different sections of the arrays uniformly; rather, voltages are preferentially supplied to the perimeter of the array. To overcome this problem, the overall array 600 may be divided into sub-arrays 610 and deliver power separately to the sub-arrays 610. The sub-arrays 610 may have voltages supplied independently and in desired arrangements. Examples of this include applying a single voltage to a common substrate or photocathode of the sub-arrays 610 and different voltages to different anodes that are unconnected to each other or applying the same voltage to a uniform anode and different voltages to individual photocathodes in the array. Alternatively, the entire array may have multiple conductive leads from the voltage source and provided to selected areas of the array or may have continuous strips of the conductive leads crossing the array in a grid-like manner. Further, each device may be individually excited and ballasted, i.e. at least one photodetector in the array independently operable from another photodetector in the array. The latter may be accomplished with discrete components or by tailoring the electrical properties of the photocathode or substrate. These arrangements are only examples of techniques that may be used to provide the desired uniformity to the array.

Such designs minimize ohmic losses in the array as arrays increase in size and improve the characteristics and reproducibility for the detection of light impinging on the array. In addition, these designs decrease the voltage variation appearing across the array. This decrease is such that when a minimum voltage that is sufficient to produce a plasma from the gas present in the cavities of at least 10 of the devices is applied, the voltage difference between the photocathode and anode at every cavity of the microdischarge detectors has a voltage difference of no more than a desired percentage of the average voltage difference of a large number of individual devices in the array. Thus, for example, a voltage of 100V applied to 1000 devices in an array could be controlled such that a variation of no more than 5V (5%) existed across the array. In addition, use of a multiple film dielectric as the insulator allows one to realize much larger arrays that are well behaved.

Figure 12:
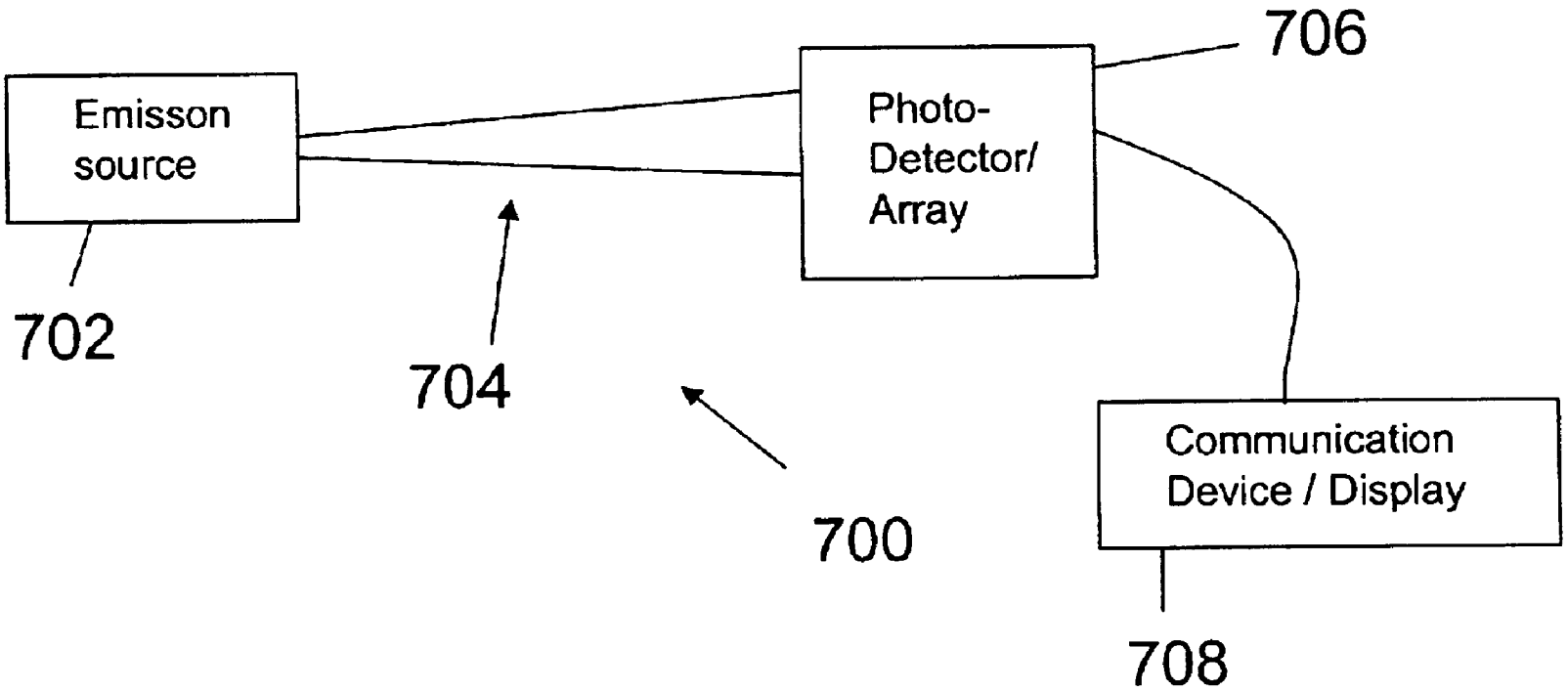
FIG. 12 is another embodiment of the invention in which a system containing the photodetector is present.

Another embodiment is a detector system that is depicted in FIG. 12. The detector system 700 contains an emission source 702 and a microdischarge photodetector 706 or array of detectors. The photodetector 706 may be formed in any manner discussed above. The photodetector 706 is disposed in the system 700 to detect light 704 from the emission source 702 that is incident on the photodetector 706 and generate a signal that is proportional to an amount of the incident light falling on the photodetector 706. The photodetector 706 is connected with a communication device 708 that receives the signal from the photodetector 706 and notifies an individual of the signal. This communication device 708 may be a display that displays results to an observer. Various electronics used to, for instance, generate the incident light 704 from the emission source 702 or detect or amplify the signal from the photodetector 706 are not shown. Nor is any hardware or software used to detect or process the signal shown, for example. Similarly, optics and/or optical fiber that guides the incident light 704 to the photodetector 706 or guide emitted light from the photodetector 706 are not shown in the figure. The emission source 702 may be a laser or LED or may be a source of light that does not require a user to generate the incident light. The signal supplied from the photodetector 706 may either be current or light generated by the photodetector 706 that is proportional to the amount and/or photon energy of the incident light 704.

Experimental Results

Inverted square pyramidal cavities, 50 or 100 $\mu$m square at the base and 35 $\mu$m or 70 $\mu$m (respectively) in depth, were formed by wet etching in KOH in a p-type (100) Si wafer having a bulk resistivity of 6–8 Ω-cm and a thickness of 300 $\mu$m. The insulator consisted of 800 nm of $SiO_2$ and a dry etchable polyimide film of about 8 $\mu$m. A 200 nm thick Ni layer served as the device anode. The finished devices were evacuated to about $10^{-7}$ Torr in a turbomolecular-pumped vacuum chamber and back-filled with research grade rare gas. All of the experiments were conducted at room temperature and with DC excitation of the devices. The microdischarge devices were operated in the equivalent of a simmer or standby mode to operate as a photodetector.

Figure 7:
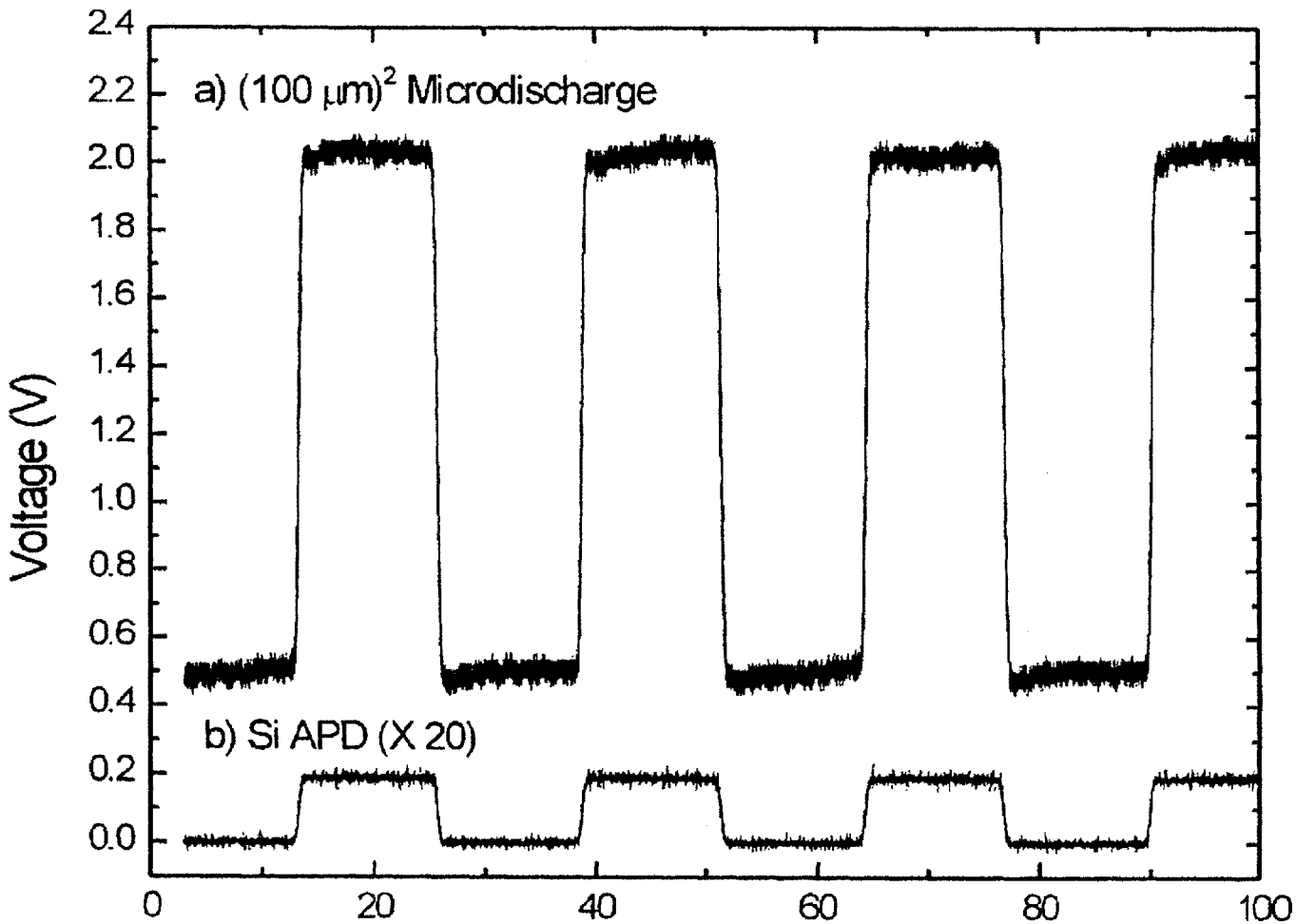
FIG. 7 illustrates output voltage/current waveforms of an embodiment of the microdischarge detector of the present invention as well as a conventional Si APD.

The upper waveform of FIG. 7 illustrates the output voltage/current waveforms observed when a $(100\ \mu m)^2$ pyramidal cathode microdischarge photodetector is irradiated at normal incidence by a chopped light source. In this instance, the beam from a He—Ne laser located about 1 m from the microdischarge was chopped at 40 Hz and the microdischarge was operating in 500 Torr of Ne with a voltage and quiescent current of 267 V and 36 $\mu$A, respectively. The total laser power at the photodetector plane was measured with a calibrated photodiode to be 150 $\mu$W. Measurements of the laser power transmitted by a scanning slit show that a maximum of 960±100 nW illuminates the $(100\ \mu m)^2$ active area of the microdischarge device. The roughly 1.5 V voltage excursion of the upper waveform of FIG. 7 corresponds to a photogeneration current of 460 $\mu$A flowing through a 3.3 kΩ shunt resistance. Consequently, the photoresponsivity of the microdischarge device at 633 nm, defined as the change in the microdischarge current (denoted δI) induced by an incident beam of light centered at wavelength $\lambda_0$, normalized to the incident beam power, is 479 $A\text{-}W^{-1}$. The responsivity of the device is large enough to easily distinguish the light to be detected from the background radiation from the plasma impinging on the photocathode, although conventional lock-in detection techniques may be used to increase the signal to noise ratio. Additionally, conventional techniques may be used to convert the current to a measured voltage or other measured quality.

A large difference is seen when comparing this result with the response of a commercially-available Si avalanche photodiode (APD) under identical illumination conditions and having a manufacturer-specified response at 633 nm of about 30 $A\text{-}W^{-1}$, as shown in the lower waveform of FIG. 7. The APD waveform shown has been magnified by a factor of 20. In addition, the active area of the APD (about $10^{-2}$ $cm^2$) is two orders of magnitude larger than that of the microdischarge photodetector. This leads to the conclusion that the Si microdischarge photodetector is considerably more sensitive than the Si photodiode at this wavelength.

To determine the absolute spectral response of the microdischarge detector in the ultraviolet, visible, and near-infrared (about 350–1200 nm), experiments were conducted with three calibrated light sources. In addition to the He—Ne laser measurements briefly described earlier, experiments in this region were carried out with a 150 W xenon lamp, filtered by a 0.125 m monochromator, serving as the optical source. When the monochromator was operated in first order with a 1200 lines/mm grating having a blaze wavelength of 350 nm, the lamp/monochromator combination produced tunable incoherent radiation having a spectral breadth of 14 nm FWHM. The exit slit of the monochromator was situated 6.8 cm from the surface of the microdischarge device, resulting in an approximately rectangular illumination beam having cross-sectional dimensions of $2.7\times1.8\ cm^2$. Scanning slit measurements revealed that only $2.6\times10^{-4}$ of the lamp power reaching the calibrated power detector falls within the active area of the microdischarge detector. When the monochromator was set at 632 nm, about 10 nW of incident power yielded a photocurrent of 5.4 $\mu$A which corresponds to a photoresponse of 510 A-W$^{-1}$. This value is within 7% of the result obtained with the He—Ne laser, despite the roughly two orders of magnitude lower intensity provided by the lamp.

Owing to the rapidly falling output of the lamp and the response of the monochromator's grating beyond about 700 nm, near-infrared (750–1200 nm) measurements were conducted by filtering the Xe lamp output solely with bandpass filters having spectral widths of about 60 nm FWHM. The calibration procedure followed was the same as that described earlier for the monochromator-based measurements. Throughout all of the spectral response experiments, the voltage applied across the discharge and ballast resistor was held constant at 260 V. For 500 Torr of Ne, this yields a device voltage and quiescent current of 247.3 V and 8.6 $\mu$A, respectively.

Figures 8A, 8B:
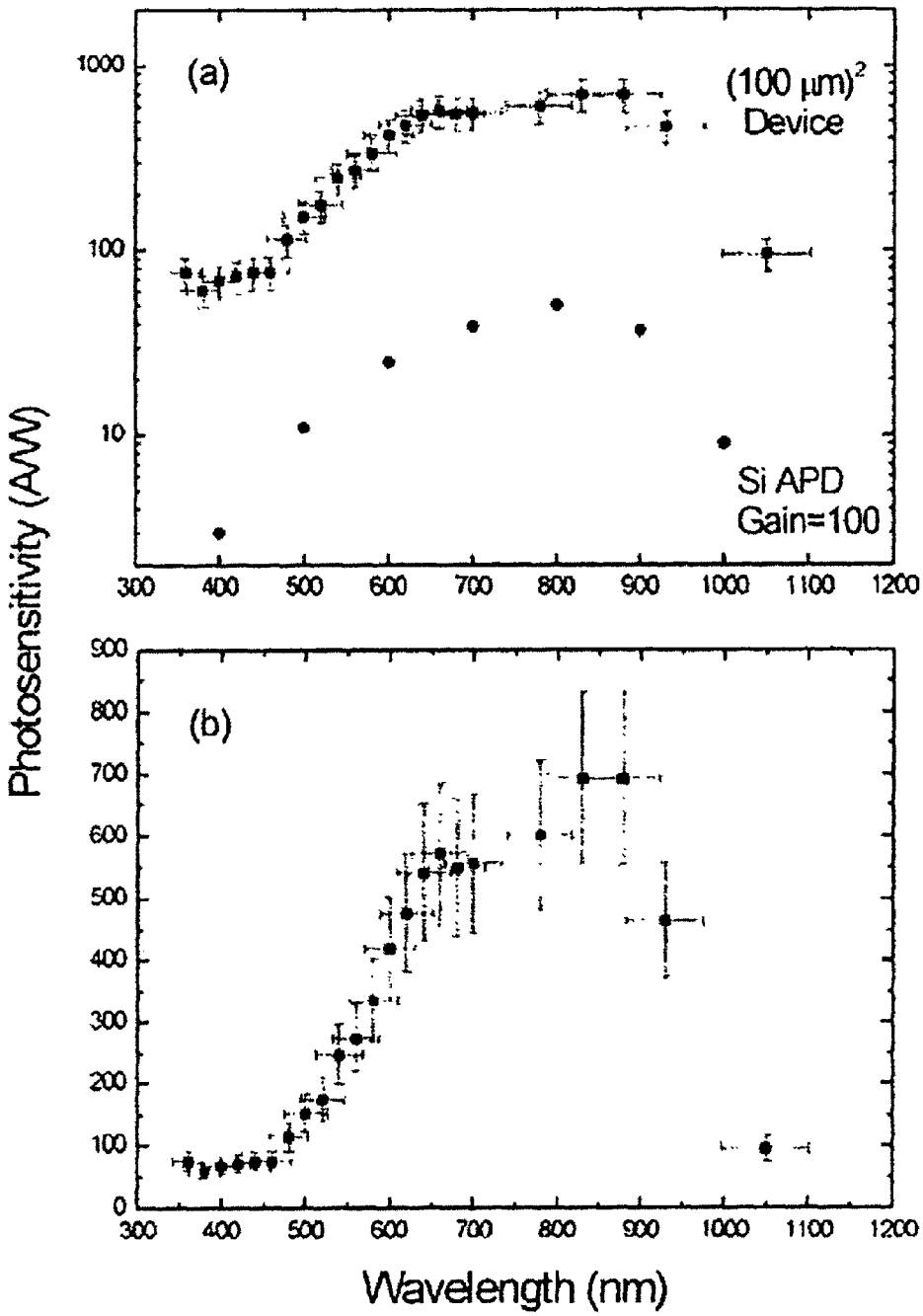

FIGS. 8*a* and 8*b* show the spectral response on logarithmic and linear scales, respectively, in the 350–1050 nm region for a Si/$SiO_2$/polyimide/Ni device with a (100 $\mu$m)$^2$ pyramidal microcavity and operating in 500 Torr of Ne. For comparison, the sensitivity of a commercially-available APD (Hamamatsu S2381) in this spectral region is also illustrated. Error bars associated with the present measurements are also given and reflect the uncertainties in the determination of the optical power intercepted by the device. Although the spectral profile of the microdischarge response is quite similar to that for the Si APD, the absolute responsitivity of the microdischarge exceeds that for the Si device by more than an order of magnitude. The maximum response of the microdischarge photodetector is 700±150 A-W$^{-1}$ at 850 nm and falls slowly toward the blue (570±120 A-W$^{-1}$ at 660 nm). In varying the Ne pressure from 350 to 700 Torr, it was found that 500 Torr yields the largest peak sensitivity, about 6% higher than that for $p_{Ne}$=700 Torr. This is substantially different from use of the microdischarge device for emission purposes, in which optimization of the device characteristics yielded a target pressure of 700 Torr. Gases other than Ne have not yet been examined.

Figure 9:
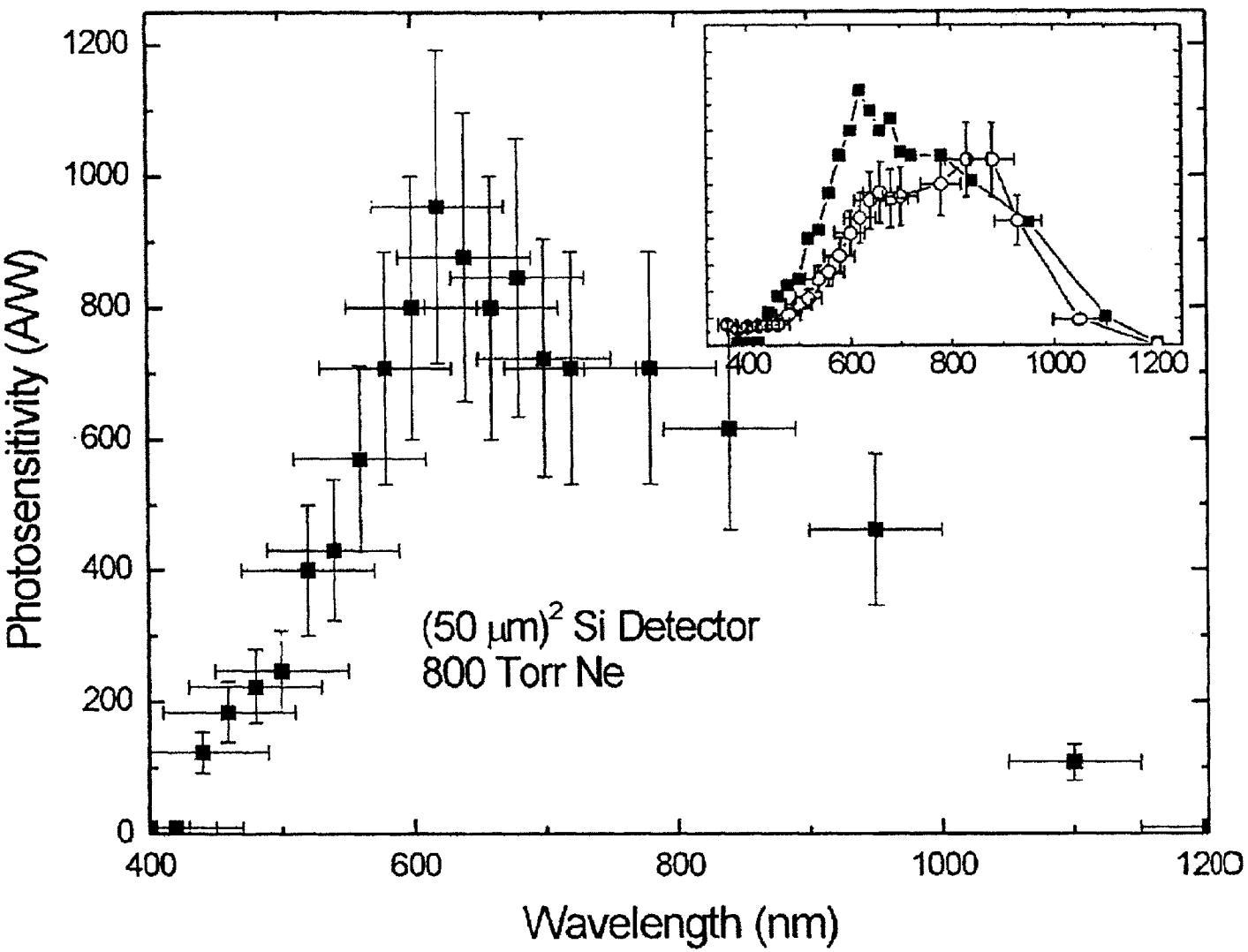
FIG. 9 shows the spectral response of an embodiment of the microdischarge detector of the present invention on a linear scale while the inset shows a comparison between the embodiments of FIG. 8 and FIG. 9.

Data similar to those of FIG. 8*b* but for a (50 $\mu$m)$^2$ microdischarge device are presented in FIG. 9. The device structure is identical to that for the larger microdischarge devices (i.e. 800 nm $SiO_2$, about 8 $\mu$m polyimide, and 200 nm Ni) but, because of its smaller dimensions and the impact of pd scaling (where p is the gas pressure and d is the width of the square pyramid at the Si surface), the photodetector prefers to operate at higher pressures. Although measurements were made for Ne pressures of 400, 500, and 800 Torr, only the 800 Torr results are shown for clarity. It is immediately evident that the peak sensitivity (950±250 A-W$^{-1}$) is about 35% higher than that for the larger device and, interestingly, the spectral profile is altered dramatically. Specifically, as illustrated by the inset of FIG. 9 which compares the spectral data for the (50 $\mu$m)$^2$ and (100 $\mu$m)$^2$ devices, the peak response for the (50 $\mu$m)$^2$ photodetector shifts to shorter wavelengths by about 0.5 eV (from about 850 nm to about 620 nm) and the spectral profile falls more slowly to the red than to the blue.

Several factors strongly suggest that the spectral response of the microdischarge photodetector, particularly for the larger active area devices, is determined primarily by the Si cathode. Not only does the spectral response of the (100 $\mu$m)$^2$ device of FIG. 8 closely follow that of a Si photodiode, but varying the gas pressure in the microdischarge detector by a factor of 2–3 has little discernible impact on the spectral profile for the device. Furthermore, microdischarge devices of dimensions similar to those of FIGS. 8 and 9 but having cylindrical cathodes (as opposed to inverted pyramids), micromachined by reactive ion etching, show no measurable photoresponse. In retrospect, this result is not surprising since a cylindrical cathode will not normally be illuminated directly by the source and absorption by the rare gas plasma in this spectral region can, to a first approximation, be neglected. However, in other detection arrangements in which the photocathode is illuminated directly, for example, by use of a fiber optic coupled to the detector, the photoresponse may increase significantly.

The high responsivities of these hybrid semiconductor/plasma devices result from the combined action of a photocathode and the plasma; specifically, the effect of enhanced photoelectron emission at the cathode surface in concert with electron avalanche in the plasma. Electron-hole pairs produced at the Si surface by above bandgap radiation increase the secondary electron emission yield in response to rare gas ions bombarding the cathode. A second contribution to electron production at the cathode is the suppression of the Si work function (or electron tunneling through the vacuum barrier) by the electric field present at the photocathode surface during normal operation of the device. Both effects are expected to be most pronounced around the perimeter of the square microdischarge at the insulator-photocathode interface where the local electric field is a maximum. The net effect, then, of photons impinging on the photocathode is to produce additional electrons (photoelectrons) in the region of the plasma near the Si cathode surface. Rapidly accelerated under the influence of the strong electric field in the cathode fall region, these photoelectrons are reproduced by impact ionization and avalanche ensues. Thus, the gas is selected such that the breakdown voltage and impact ionization coefficient of the gas is appropriate with respect to the application in which the detector is used.

The increased photosensitivity of the (50 $\mu$m)$^2$ device and the shift of the overall spectral profile towards shorter wavelengths stems from several factors. One is the increasing fraction (as the width d decreases) of the cross-sectional area of the device occupied by the high electric field region, thereby increasing photoelectron emission. However, the data of FIG. 9 also suggest that, owing to the rapidly rising power loading of the plasma that accompanies the reduction in device dimensions from FIG. 8 to FIG. 9, the optical properties of the plasma can no longer be ignored. In particular, at least a portion of the increase in the photoresponse of the 50 $\mu$m square device near $\lambda$~620 nm is quite likely due to optical effects associated with strong transitions of atomic Ne in this spectral region. Thus, selection of the gas may also entail careful examination of the optical (e.g. absorption and emission) properties as in this spectral region of interest.

Figure 10:
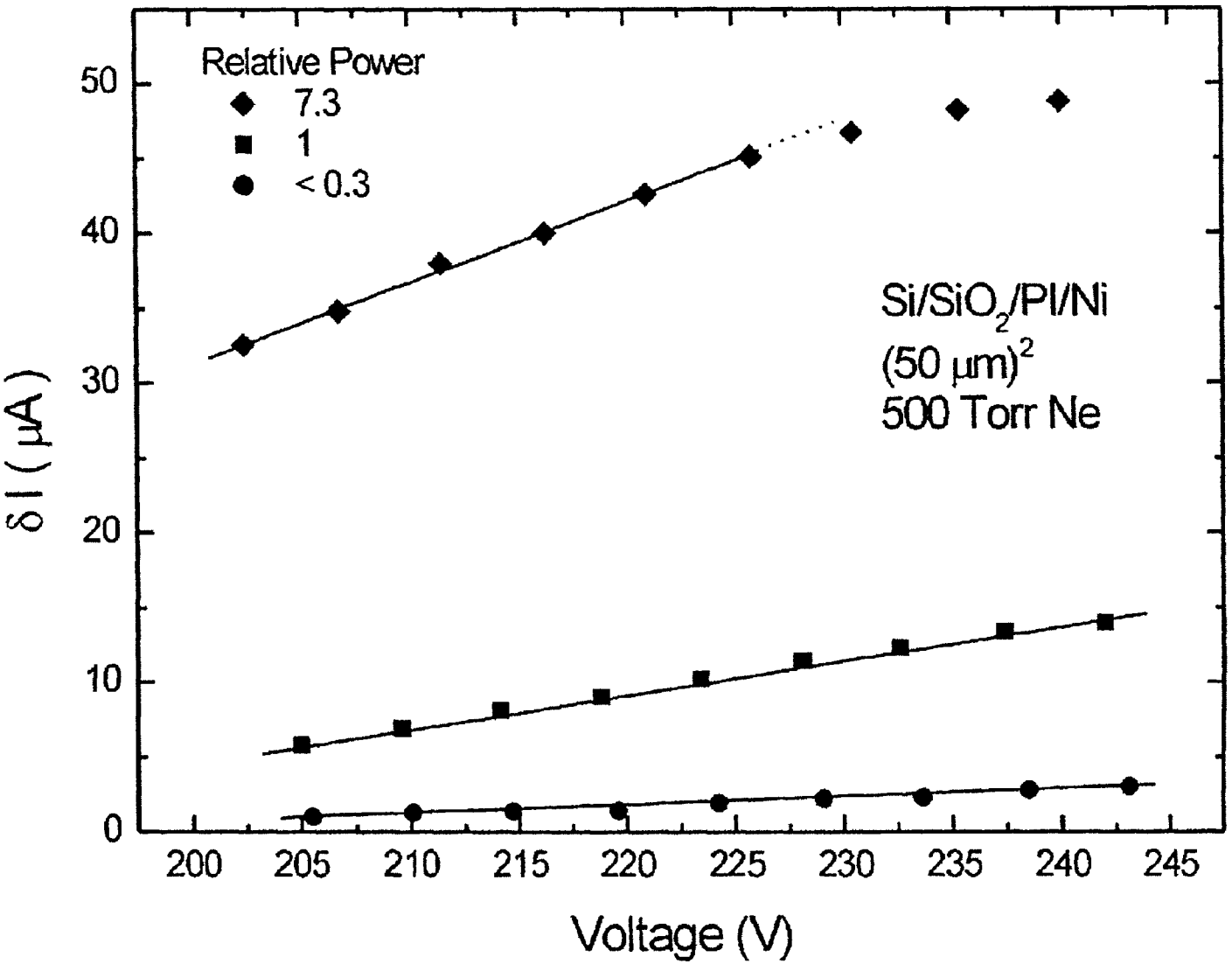
FIG. 10 is a plot of the dependence of the photogenerated current on operating voltage for different values of optical power incident on the detector for an embodiment of the microdischarge detector of the present invention.

FIG. 10 illustrates the dependence of the photogenerated current ($\delta$I) on the microdischarge operating voltage for a (50 $\mu$m)$^2$ photodetector operating in 500 Torr of Ne. Data are shown for three values of optical power (having the ratio 7.3:1:<0.3) incident on the microdischarge but the center wavelength, $\lambda_0$, of the photoexcitation beam is fixed at 500 nm ($\Delta\lambda$=14 nm FWHM). The current rises linearly with the device voltage over most of the range investigated but at the highest incident power (about 170 nW), the onset of saturation is evident for voltages above about 225 V.

Figure 11A:
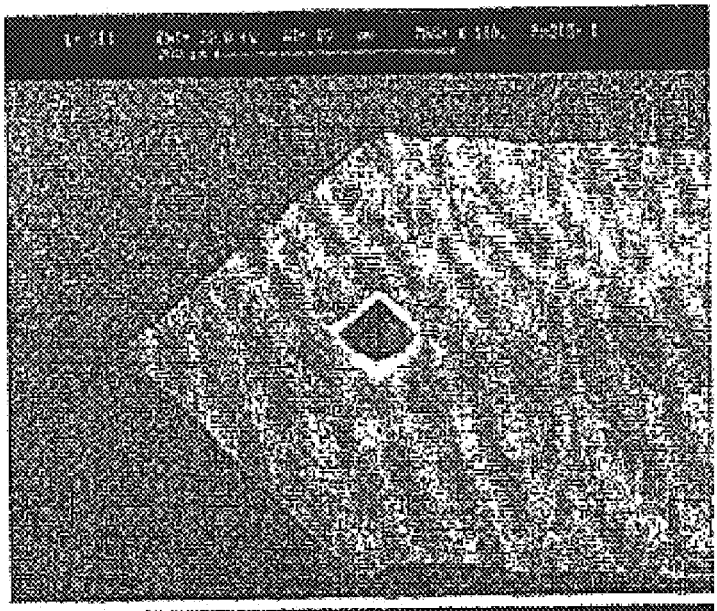
FIG. 11*a* is an SEM photograph of an embodiment of the microdischarge detector of the present invention.
Figure 11B:
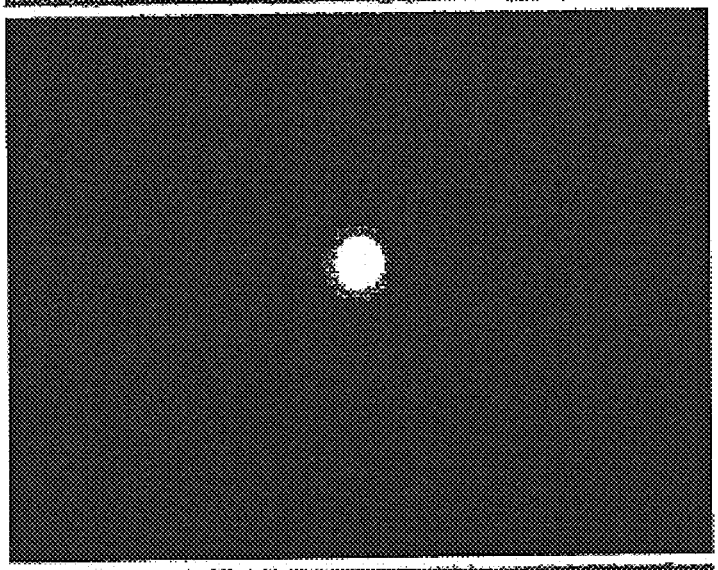
FIGS. 11*b* and 11*c* are optical micrographs of the detector in operation.
Figure 11C:
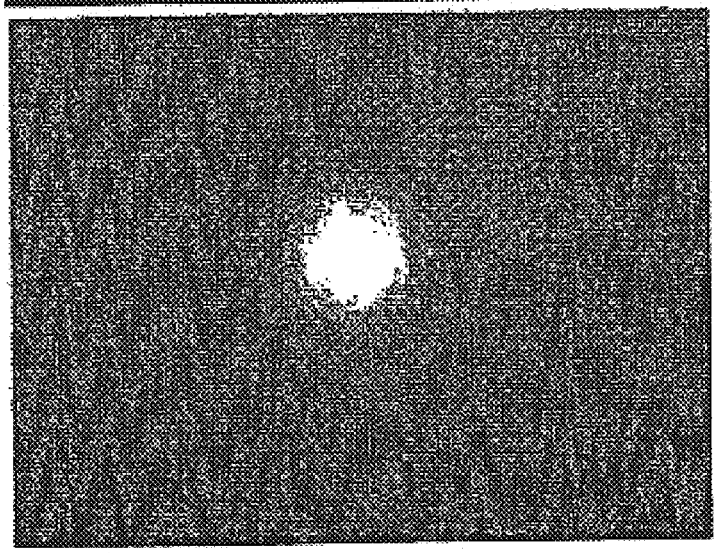

The increased conductivity and concomitant luminosity of the microdischarge under illumination is also apparent visually. Two photographs of a (50 $\mu$m)$^2$ microdischarge photodetector operating in 500 Torr of Ne are shown in FIGS. 11*a*–11*c*. FIG. 11*a* is a scanning electron micrograph (SEM) of the device itself whereas FIGS. 11*b* and 11*c* are optical micrographs of the detector in operation. With no external illumination (FIG. 11*b*, operating in the quiescent mode), the device has an operating voltage of about 247 V and 35 $\mu$A, respectively. The bottom micrograph confirms that, when the He—Ne laser irradiates the photocathode and the optical power intercepted by the device is about 0.1 $\mu$W, the current drawn by the detector rises to 113 $\mu$A which is accompanied by significantly enhanced emission from the discharge.

In summary, the photosensitivity of 50 and 100 $\mu$m square microdischarge photodetectors having an inverted pyramidal Si cathode has been demonstrated and characterized in the ultraviolet, visible, and near-infrared (350–1200 nm) regimes. When operating with 500 Torr of Ne, the $(100\ \mu m)^2$ microdischarge photodetectors exhibit responsivities of 700±150 A-W$^{-1}$ and 570±120 A-W$^{-1}$ at 850 nm and 660 nm, respectively, or more than an order of magnitude larger than peak values typical of commercially-available Si avalanche photodiodes. Maximum sensitivity occurs in the 800–900 nm region for the larger (100 $\mu$m square) devices but is blue-shifted to 600–650 nm for $(50\ \mu m)^2$ detectors. The peak response for the 50 $\mu$m square device is 950+250 A-W$^{-1}$ (at about 625 nm), an increase of about 35% over that for the $(100\ \mu m)^2$ detector.

The experimental results indicate that the semiconductor photocathode determines the spectral response of the device whereas the plasma serves as an electron multiplier. The microdischarge photodetectors resemble photomultipliers having responsivities intermediate to those for a standard (vacuum) photomultiplier (about $10^5$ A/W) and semiconductor photodiodes. However, the dynode chain in a conventional photomultiplier has been replaced by a glow discharge operating at atmospheric or near-atmospheric pressure. This is to say that the light to be detected strikes the photocathode to generate photoelectrons that are subsequently emitted from the surface of the photocathode into the plasma. The photoelectrons then accelerate due to the electric field and generate avalanche breakdown in the plasma. The electrons generated by avalanche strike the anode and are subsequently detected.

Optimizing the responsivity of the device through the choice of gases (as well as the operating characteristics thereof) and cathode material selection and design may be performed to further improve the detection characteristics in the wavelength region of interest. These optimized parameters and physical properties of the device are different from similar optimizations for emission devices. As described earlier, the photocathode in the detector can be much thinner than previous microdischarge devices optimized for emission, enabling the substrate on which the device is disposed to be formed from a much wider range of materials. Previous studies of microdischarge devices have generally focused on their emissive properties or their ability to provide ions, electrons or excited species for microetching or igniting high pressure lamps. The results reported here explore an entirely new application for microdischarges. The high gain (sensitivity), dynamic range, atmospheric operation, ability to be integrated with Si electronics, and demonstrated pixel sizes of this hybrid semiconductor/plasma photodetector make these devices able to form low cost, sensitive photodetector arrays over a broad region of the visible and near-infrared, as well as the ultraviolet and infrared, with different photocathode materials for spectroscopic and biochemical applications.

While the invention has been described with reference to specific embodiments, the description is illustrative of the invention and not to be construed as limiting the invention. Various modifications and applications may occur to those skilled in the art without departing from the true spirit and scope of the invention as defined in the appended claims.

What is claimed is:

1. A microdischarge photodetector, comprising:

a photocathode;

an anode;

an insulator disposed between the photocathode and anode; and a gas disposed in a cavity formed in the insulator, the gas having a breakdown voltage at which the gas breaks down into a plasma and impact ionization coefficient sufficient to cause avalanche breakdown in the plasma from photoelectrons ejected into the plasma from the photocathode, which are generated when light of photon energy larger than about a work function of the photocathode is incident on the photocathode.

2. The photodetector of claim 1, wherein the cavity extends into the photocathode.

3. The photodetector of claim 2, wherein a depth of the cavity in the photocathode is at most about 60 $\mu$m.

4. The photodetector of claim 1, wherein the photocathode is a semiconductor.

5. The photodetector of claim 1, wherein the insulator comprises a plurality of dielectric layers, at least two of the plurality of dielectric layers having different dielectric constants.

6. The photodetector of claim 1, further comprising an optically transmissive material that seals the cavity.

7. The photodetector of claim 1, wherein an area of the cavity at a surface of the photocathode is not greater than about $(500\ \mu m)^2$.

8. The photodetector of claim 1, wherein a thickness of the photocathode is at least about an absorption length of light to be absorbed by the photocathode and at most about five times the absorption length of light to be absorbed by the photocathode.

9. The photodetector of claim 1, further comprising a substrate, the photocathode being disposed on and contacting the substrate, the photocathode and substrate being formed from substantially different materials.

10. The photodetector of claim 1, wherein the photocathode and substrate are formed from different semiconductors.

11. The photodetector of claim 2, wherein the cavity in the photocathode is tapered.

12. The photodetector of claim 11, wherein an angle of taper is about 20 degrees to 45 degrees.

13. The photodetector of claim 1, wherein a surface of the photocathode is coated with a material having a higher secondary electron emission coefficient than the photocathode.

14. The photodetector of claim 2, wherein a shape of cavity is independent of material that forms the photocathode.

15. The photodetector of claim 1, wherein the anode comprises an electrically conducting screen.

16. The photodetector of claim 15, wherein the anode is the screen.

17. The photodetector of claim 1, wherein the breakdown voltage of the gas is at most about 120 V.

18. An array of photodetectors comprising a plurality of photodetectors according to claim 2.

19. The array of claim 18, wherein the photodetectors in the array comprise a first set of photodetectors and a second set of photodetectors that are electrically isolated from each other.

20. The array of claim 1, further comprising a coating layer that coats the photocathode with a material having one of a higher secondary electron emission coefficient than the photocathode and emission in a different wavelength range from the photocathode.

21. A method of fabricating a microdischarge photodetector comprising:

forming a photocathode on a substrate;

forming a cavity in an insulator disposed on the photocathode;

forming an anode on the insulator; and introducing a gas into the cavity, the gas having a breakdown voltage at which the gas breaks down into a plasma and impact ionization coefficient sufficient to cause avalanche breakdown in the plasma from photoelectrons ejected into the plasma from the photocathode, which are generated when light of photon energy larger than about a work function of the photocathode is incident on the photocathode.

22. The method of claim 21, further comprising limiting an area of the cavity at a surface of the photocathode to at most about $(500\ \mu m)^2$.

23. The method of claim 21, further comprising extending the cavity into the photocathode.

24. The method of claim 23, further comprising limiting a depth of the cavity in the photocathode to at most about 60 $\mu$m.

25. The method of claim 21, further comprising forming the photocathode from a semiconductor.

26. The method of claim 21, further comprising forming the insulator from a plurality of dielectric layers, at least two of the plurality of dielectric layers having different dielectric constants.

27. The method of claim 21, further comprising sealing the cavity with an optically transmissive material.

28. The method of claim 21, further comprising limiting a thickness of the photocathode to between about one absorption length and five absorption lengths of light to be absorbed by the photocathode.

29. The method of claim 28, further comprising forming the photocathode on the substrate such that the photocathode contacts the substrate and forming the photocathode and substrate from substantially different materials.

30. The method of claim 21, further comprising forming the photocathode and substrate from different semiconductors.

31. The method of claim 23, further comprising tapering the cavity in the photocathode.

32. The method of claim 31, further comprising forming an angle of taper between at least 20 degrees and at most 45 degrees.

33. The method of claim 31, further comprising shaping the taper as determined by lattice structure of the photocathode.

34. The method of claim 33, further comprising wet etching the photocathode to form the taper.

35. The method of claim 21, further comprising affixing a conducting screen to an end of the cavity.

36. The method of claim 21, further comprising forming the anode from an electrically conducting screen.

37. The method of claim 21, further comprising limiting the breakdown voltage of the gas to at most about 120 V.

38. The method of claim 21, further comprising arranging a plurality of photodetectors into an array of photodetectors.

39. The method of claim 38, further comprising filling different cavities in the array with different gases.

40. The method of claim 21, further comprising coating the photocathode with a material having one of a higher secondary electron emission coefficient than the photocathode and emission in a different wavelength range from the photocathode.

41. A method of detecting light using a microdischarge photodetector comprising:

applying a voltage between a photocathode and anode that is sufficiently large to form a plasma of a gas in a cavity disposed in an insulator separating the photocathode and anode and avalanche breakdown of the plasma;

illuminating the photocathode with incident light of photon energy larger than about a work function of the photocathode to eject photoelectrons into the plasma; and detecting an avalanche of the photoelectrons.

42. The method of claim 41, further comprising detecting the incident light by detecting an increase in current flowing in the photodetector when the incident light is present.

43. The method of claim 41, further comprising detecting the incident light by detecting an increase in light emission from the photodetector when the incident light is present.

44. The method of claim 41, further comprising forming a plasma from gas in a cavity disposed in the photocathode that extends from the cavity in the insulator.

45. The method of claim 41, further comprising illuminating a semiconductor photocathode with the incident light.

46. The method of claim 41, further comprising illuminating the photocathode with the incident light through an optically transmissive material that seals the cavity.

47. The method of claim 44, further comprising illuminating tapered sidewalls of the cavity in the photocathode.

48. The method of claim 41, further comprising maintaining the plasma with a voltage of at most about 120 V between the photocathode and the anode.

49. The method of claim 41 in which the photodetector is disposed in an array of photodetectors.

50. The method of claim 49, further comprising forming plasmas of different gases in different cavities for different photodetectors in the array.

51. The method of claim 49, further comprising illuminating the photodetectors in the array of photodetectors such that a first set of photocathodes in the array are illuminated with light of photon energy larger than about a work function of the first set of photocathodes and illuminating a second set of photocathodes in the array with light of photon energy smaller than about a work function of the second set of photocathodes, thereby ejecting photoelectrons into plasmas associated with the first set of photocathodes but not the second set of photocathodes.

52. The method of claim 51, further comprising forming the plasmas in the first set of photocathodes but not forming plasmas in the second set of photocathodes.

53. The method of claim 52, further comprising applying a voltage between the first set of photocathodes and anodes associated with the first set of photocathodes but not between the second set of photocathodes anodes associated with the second set of photocathodes.

54. The method of claim 41, further comprising forming the plasma only when until the incident light is present.

55. A detector system comprising:

an emission source; and a microdischarge photodetector comprising a photocathode, an anode, an insulator disposed between the photocathode and anode, and a gas disposed in a cavity formed in the insulator, the photodetector disposed to detect light from the emission source that is incident on the photodetector and generate a signal that is proportional to an amount of the incident light falling on the photodetector.

56. The detector system of claim 55, further comprising a communication device that receives the signal from the photodetector and notifies an individual of the signal.

57. The detector system of claim 56, wherein the communication device is a display that displays results to an observer.

58. The detector system of claim 55, wherein the cavity extends into the photocathode.

59. The detector system of claim 55, wherein the photocathode is a semiconductor.

60. The detector system of claim 55, wherein the insulator comprises a plurality of dielectric layers, at least two of the plurality of dielectric layers having different dielectric constants.

61. The detector system of claim 55, further comprising an optically transmissive material that seals the cavity.

62. The detector system of claim 55, wherein a thickness of the photocathode is at least about an absorption length of the incident light and at most about five times the absorption length of the incident light.

63. The detector system of claim 55, further comprising a substrate, the photocathode being disposed on and contacting the substrate, the photocathode and substrate being formed from substantially different materials.

64. The detector system of claim 58, wherein the cavity in the photocathode is tapered.

65. The detector system of claim 55, wherein a surface of the photocathode is coated with a material having a higher secondary electron emission coefficient than the photocathode.

66. The detector system of claim 55, wherein the anode comprises an electrically conducting screen.

67. The detector system of claim 55, wherein an operating voltage of the photodetector is at most about 120 V.

68. The detector system of claim 55, further comprising an array of the photodetectors.

69. The detector system of claim 55, wherein the detector system is configured to supply the signal when a voltage is applied between the photocathode and anode that is sufficiently large to form a plasma of the gas and the photocathode is illuminated with the incident light, which has a photon energy larger than about a work function of the photocathode to thereby eject photoelectrons into the plasma, and the detector is configured to detect an avalanche of the photoelectrons.

70. The detector system of claim 55, wherein the signal supplied is proportional to an increase in current flowing in the photodetector.

71. The detector system of claim 55, wherein the signal supplied is proportional to an increase in light emission from the photodetector.

72. The detector system of claim 68, wherein at least one cavity in the array contains a different gas from another cavity in the array.

73. The detector system of claim 68, wherein at least one photocathode in the array has a different work function from another photocathode in the array.

74. The detector system of claim 68, wherein at least one photocathode in the array is coated with a material having one of a higher secondary electron emission coefficient and emission in a different wavelength range from the at least one photocathode.

75. The detector system of claim 68, wherein the array is configured such that at least one photodetector in the array is operable independently from another photodetector in the array.

* * * * *